US011752054B2

(12) United States Patent
Monson et al.

(10) Patent No.: US 11,752,054 B2
(45) Date of Patent: Sep. 12, 2023

(54) LIFT SYSTEMS WITH STRAIN GAUGES INCORPORATED IN LOAD BEAMS AND METHODS FOR OPERATING THE SAME

(71) Applicant: LIKO RESEARCH & DEVELOPMENT AB, Lulea (SE)

(72) Inventors: Gavin Monson, Oxford, OH (US); James Walke, Batesville, IN (US); Jonathan D. Turner, Dillsboro, IN (US); Aziz Bhai, Fishers, IN (US)

(73) Assignee: Liko Research & Development AB, Lulea (SE)

( * ) Notice: Subject to any disclaimer, the term of this patent is extended or adjusted under 35 U.S.C. 154(b) by 29 days.

(21) Appl. No.: 17/517,813

(22) Filed: Nov. 3, 2021

(65) Prior Publication Data

US 2022/0133566 A1 May 5, 2022

Related U.S. Application Data

(60) Provisional application No. 63/109,924, filed on Nov. 5, 2020.

(51) Int. Cl.
*A61G 7/10* (2006.01)

(52) U.S. Cl.
CPC ..... *A61G 7/1017* (2013.01); *A61G 7/108* (2013.01); *A61G 7/1046* (2013.01); *A61G 7/1051* (2013.01); *A61G 2200/34* (2013.01); *A61G 2203/10* (2013.01)

(58) Field of Classification Search
CPC ..... A61G 2200/34; A61G 2203/10; A61G 2203/20; A61G 2203/44
See application file for complete search history.

(56) References Cited

U.S. PATENT DOCUMENTS 2,703,980 A * 3/1955 Tell ..... G01L 1/04 73/862.642
4,482,783 A * 11/1984 Laimins ..... G01G 19/14 177/211
4,944,056 A 7/1990 Schroeder et al.
5,033,563 A * 7/1991 Brainerd, Jr. ..... G01G 19/445 177/132

(Continued)

FOREIGN PATENT DOCUMENTS

EP 2671557 A1 * 12/2013 ..... A61G 7/1015
GB 2549475 A * 10/2017 ..... A61G 7/108
JP 2012065463 A 3/2012

*Primary Examiner* — Eric J Kurilla
(74) *Attorney, Agent, or Firm* — Dinsmore & Shohl LLP

(57) ABSTRACT

Overhead lift units are disclosed. In one embodiment, an overhead lift unit includes a carriage having wheels engageable with a rail, a lift frame coupled to the carriage such that the lift frame is suspended from the carriage, and a pair of load beams. The lift frame includes a lift strap extending from the lift frame and a pair of connection points extending from the lift frame. Each load beam of the pair of load beams is attached to one connection point of the pair of connection points of the lift frame at an inferior end of the load beam. Each load beam of the pair of load beams is attached to the carriage at a superior end of the load beam. And each load beam of the pair of load beams comprises a strain gauge operable to register a weight supported on the lift strap.

27 Claims, 9 Drawing Sheets

(56) References Cited

U.S. PATENT DOCUMENTS

| | | | | |
|---|---|---|---|---|
| 5,131,482 | A * | 7/1992 | Davis | G01G 19/08 177/25.14 |
| 5,511,256 | A * | 4/1996 | Capaldi | A61G 7/1051 403/217 |
| 5,809,591 | A * | 9/1998 | Capaldi | A61G 7/108 5/89.1 |
| 7,021,427 | B2 | 4/2006 | Skovgaard et al. | |
| 9,463,128 | B2 | 10/2016 | Ng | |
| 10,376,434 | B2 | 8/2019 | Andersson et al. | |
| 11,096,852 | B2 * | 8/2021 | Bolin | G01L 5/0071 |
| 2014/0210223 | A1 | 7/2014 | Lamela | |
| 2015/0143627 | A1 * | 5/2015 | McBride | A61H 3/008 5/81.1 R |
| 2017/0003159 | A1 * | 1/2017 | Kostic | G01G 23/01 |
| 2017/0326013 | A1 * | 11/2017 | Hyde | A61G 7/1065 |
| 2018/0021616 | A1 * | 1/2018 | Orady | A63B 24/0087 482/5 |
| 2018/0177652 | A1 | 6/2018 | Furman et al. | |
| 2019/0151178 | A1 * | 5/2019 | Westwood | A61G 7/1042 |
| 2020/0289352 | A1 * | 9/2020 | Kaikenger | H02J 7/02 |
| 2022/0054340 | A1 * | 2/2022 | Oestergaard | A61H 1/0262 |

* cited by examiner

LIFT SYSTEMS WITH STRAIN GAUGES INCORPORATED IN LOAD BEAMS AND METHODS FOR OPERATING THE SAME

CROSS-REFERENCE TO RELATED APPLICATION

This application claims priority to U.S. Provisional Patent Application No. 63/109,924, filed Nov. 5, 2020 and entitled "Lift Systems with Strain Gauges Incorporated in Load Beams and Methods for Operating the Same," the entire contents of which is hereby incorporated by reference in its entirety, including the drawings thereof.

TECHNICAL FIELD

The present specification generally relates to lift systems and, more particularly, to overhead lift units for lifting patients.

BACKGROUND

Overhead lift units, such as patient lifts used in the health care industry, may generally comprise an actuator, such as an electric motor or similar actuator, coupled to a cable lift system, such as a lifting strap. The actuator facilitates actuation of the cable lift system thereby raising and/or lowering a patient attached to the cable lift system. The lift unit may be coupled to a rail system with a carriage which facilitates positioning the lift unit with respect to the rail system. Positioning the unit along the rail system may be accomplished manually or, in the alternative, with a motor mechanically coupled to the carriage and operable to traverse the carriage and lift unit over the span of the rail system.

A need exists for alternative overhead lift systems that facilitate determining a weight of a patient coupled to the overhead lift unit and also facilitate adjusting the operation of the lift system based on the determined weight.

SUMMARY

In a first aspect, an overhead lift unit comprising: a carriage, the carriage comprising wheels engageable with a rail; a lift frame coupled to the carriage such that the lift frame is suspended from the carriage, the lift frame comprising: a lift strap extending from the lift frame; an actuator coupled to the lift strap, the actuator selectively paying-out and taking up the lift strap; and a pair of connection points extending from the lift frame; and a pair of load beams, wherein: each load beam of the pair of load beams is attached to one connection point of the pair of connection points of the lift frame at an inferior end of the load beam; each load beam of the pair of load beams is attached to the carriage at a superior end of the load beam; and each load beam of the pair of load beams comprises a strain gauge operable to register a weight supported on the lift strap.

A second aspect includes the overhead lift unit of the first aspect, the overhead lift unit further comprising an electronic control unit communicatively coupled to each load beam, the electronic control unit comprising a processor communicatively coupled to a non-transitory memory storing computer readable and executable instructions that, when executed by the processor cause the processor to receive signals from each load beam indicative of a weight supported on the lift strap.

A third aspect includes the overhead lift unit of any of the first-second aspects, wherein the computer readable and executable instructions further cause the processor to display the weight supported on the lift strap on a hand controller of the overhead lift unit.

A fourth aspect includes the overhead lift unit of any of the first-third aspects, wherein: the electronic control unit is communicatively coupled to the actuator; and the computer readable and executable instructions, when executed by the processor, further cause the processor to modulate the pay-out or take-up of the lift strap based on the weight supported on the lift strap.

A fifth aspect includes the overhead lift unit of any of the first-fourth aspects, the overhead lift unit further comprising a transfer motor coupled to the wheels of the carriage and configured to drive the overhead lift unit along the rail when the wheels are engaged with the rail, wherein: the electronic control unit is communicatively coupled to the transfer motor; and the computer readable and executable instructions, when executed by the processor, further cause the processor to modulate a traverse rate of the transfer motor based on the weight supported on the lift strap.

A sixth aspect includes the overhead lift unit of any of the first-fifth aspects, wherein the computer readable and executable instructions, when executed by the processor, further cause the processor to transmit the weight supported on the lift strap and one or more operating parameters of the overhead lift unit to a wireless control network.

A seventh aspect includes the overhead lift unit of any of the first-sixth aspects, the overhead lift unit further comprising a housing, wherein: the housing at least partially encloses the lift frame; and each connection point of the pair of connection points extends from a superior surface of the housing.

An eighth aspect includes the overhead lift unit of any of the first-seventh aspects, the overhead lift unit further comprising a boot, wherein: the boot couples to the superior surface of the housing at a bezel; and the boot laterally surrounds the pair of load beams.

A ninth aspect includes the overhead lift unit of any of the first-eighth aspects, wherein each load beam comprises a strain relief connector, wherein an electrical interconnect of the strain gauge of each load beam extends from each load beam through the strain relief connector.

A tenth aspect includes the overhead lift unit of any of the first-ninth aspects, wherein: the lift strap extends from a center of mass of the lift frame; the pair of load beams are positioned on a longitudinal centerline of the lift frame passing through the center of mass of the lift frame; and the pair of load beams are equidistantly and symmetrically spaced from a lateral centerline of the lift frame passing through the center of mass of the lift frame.

An eleventh aspect includes the overhead lift unit of any of the first-tenth aspects, wherein: the carriage comprises a first carriage unit and a second carriage unit, wherein each of the first carriage unit and the second carriage unit comprise: a truck; and wheels extending from the truck, wherein the truck of the first carriage unit and the truck of the second carriage unit are hingedly connected.

A twelfth aspect includes the overhead lift unit of any of the first-eleventh aspects, wherein each load beam of the pair of load beams comprises a tab at the inferior end, the tab having a tab width less than a body width of the load beam.

A thirteenth aspect includes the overhead lift unit of any of the first-twelfth aspects, wherein: each connection point of the pair of connection points of the lift frame comprises a clevis; and the tab of each load beam is pivotably connected to a corresponding clevis of the pair of connection points.

A fourteenth aspect includes the overhead lift unit of any of the first-thirteenth aspects, wherein each load beam of the pair of load beams comprises a clevis at the superior end of each load beam.

A fifteenth aspect includes the overhead lift unit of any of the first-fourteenth aspects, wherein each load beam is pivotably connected to the carriage at the clevis of each load beam.

In a sixteenth aspect, a method of operating an overhead lift unit comprising: determining, with an electronic control unit, a weight supported on a lift strap of the overhead lift, wherein a lift frame of the overhead lift is coupled to a rail with load beams communicatively coupled to the electronic control unit and the load beams are operable to detect the weight supported on the lift strap; and displaying the weight supported on the lift strap on a display device.

A seventeenth aspect includes the method of the sixteenth aspect, the method further comprising: modulating an actuator of the overhead lift unit based on the determined weight supported on the lift strap, wherein the actuator selectively pays-out or takes-in the lift strap from the overhead lift unit.

An eighteenth aspect includes the method of any of the sixteenth-seventeenth aspects, wherein the modulating comprises: determining a speed for the lift strap to be paid-out or taken-in from the lift frame; and determining an acceleration or deceleration for the lift strap to be paid-out or taken-in from the lift frame, wherein the actuator is pulse-width modulated to achieve the acceleration or deceleration.

A nineteenth aspect includes the method of any of the sixteenth-eighteenth aspects, the method further comprising modulating a transfer motor of the overhead lift unit based on the weight supported on the lift strap, wherein the transfer motor traverses the overhead lift unit along the rail.

A twentieth aspect includes the method of any of the sixteenth-nineteenth aspects, wherein modulating the transfer motor comprises: determining a speed for the overhead lift unit to be traversed along the rail; and determining an acceleration or deceleration for the overhead lift unit to be traversed along the rail, wherein the transfer motor is pulse width modulated to achieve the acceleration or deceleration.

In a twenty-first aspect, a method of calibrating an overhead lift unit, comprising: suspending a first known weight from a lift strap of the overhead lift unit, wherein the lift strap extends from a lift frame of the overhead lift unit; suspending a second known weight from the lift strap of the overhead lift unit, wherein the overhead lift unit further comprises: a pair of load beams, wherein: each load beam of the pair of load beams is attached to one connection point of a pair of connection points of the lift frame; and each load beam of the pair of load beams comprises a strain gauge operable to register a weight supported on the lift strap; determining a first load beam constant for a first load beam of the pair of load beams; and determining a second load beam constant for a second load beam of the pair of load beams, wherein: the first load beam constant and the second load beam constant are determined based on: the first known weight; the second known weight; and tension readouts in the first load beam and the second load beam in response to suspending the first known weight and the second known weight from the lift strap.

A twenty-second aspect includes the method of the twenty-first aspect, wherein the pair of load beams are positioned on a longitudinal centerline of the lift frame passing through a center of mass of the lift frame; and the pair of load beams are equidistantly and symmetrically spaced from a lateral centerline of the lift frame passing through the center of mass of the lift frame.

A twenty-third aspect includes the method of any of the twenty-first-twenty-second aspects, wherein the lift strap extends from the center of mass of the lift frame.

A twenty-fourth aspect includes the method of any of the twenty-first-twenty-third aspects, wherein the first known weight is less than or equal to forty pounds; and the second known weight is less than or equal to forty pounds.

A twenty-fifth aspect includes the method of any of the twenty-first-twenty-fourth aspects, wherein the first known weight is less than or equal to thirty pounds; and the second known weight is less than or equal to thirty pounds.

A twenty-sixth aspect includes the method of any of the twenty-first-twenty-fifth aspects, wherein the first known weight is less than or equal to twenty pounds; and the second known weight is less than or equal to twenty pounds.

A twenty-seventh aspect includes the method of any of the twenty-first-twenty-sixth aspects, further comprising determining a first tension readout in the first load beam in response to suspending the first known weight from the lift strap; determining a first tension readout in the second load beam in response to suspending the first known weight from the lift strap; determining a second tension readout in the first load beam in response to suspending the second known weight from the lift strap; and determining a second tension readout in the second load beam in response to suspending the second known weight from the lift strap.

A twenty-eighth aspect includes the method of any of the twenty-first-twenty-seventh aspects, wherein the first load beam constant and the second load beam constant are determined in response to determining the first tension readout in the first load beam, the first tension readout in the second load beam, the second tension readout in the first load beam, and the second tension readout in the second load beam.

A twenty-ninth aspect includes the method of any of the twenty-first-twenty-eighth aspects, wherein the first load beam constant and the second load beam constant are determined with an electronic control unit of the overhead lift unit; and the determination of the first load beam constant and the second load beam constant is based at least in part on a calibration algorithm, wherein the calibration algorithm comprises a formula to determine the first load beam constant and the second load beam constant, wherein the formula comprises:

$$\underline{Tk} = \underline{W}, \text{ wherein:} \tag{i}$$

$$\underline{T} = \begin{bmatrix} T11 & T21 \\ T12 & T22 \end{bmatrix}, \text{ wherein:} \tag{ii}$$

T11 is a first tension readout in the first load beam in response to suspending the first known weight from the lift strap, T21 is a first tension readout in the second load beam in response to suspending the first known weight from the lift strap, T12 is a second tension readout in the first load beam in response to suspending the second known weight from the lift strap, and T22 is a second tension readout in the second load beam in response to suspending the second known weight from the lift strap;

$$\underline{W} = \begin{bmatrix} w1 \\ w2 \end{bmatrix}, \text{ wherein:} \tag{iii}$$

w1 is a weight of the first known weight, and w2 is a weight of the second known weight; and $$\underline{k} = \begin{bmatrix} k1 \\ k2 \end{bmatrix}, \text{ wherein:} \quad \text{(iv)}$$

k1 is the load beam constant for the first load beam and k2 is the load beam constant for the second load beam.

A thirtieth aspect includes the method of any of the twenty-first-twenty-ninth aspects, wherein the first load beam constant and the second load beam constant are determined with an electronic control unit of the overhead lift unit; and the determination of the first load beam constant and the second load beam constant is based at least in part on a calibration algorithm, wherein the calibration algorithm comprises a formula to determine the first load beam constant and the second load beam constant, wherein the formula comprises a system of equations further comprising:

$$k1(T11)+k2(T21)=w1$$

$$k1(T12)+k2(T22)=w2, \text{ wherein:}$$

T11 is a first tension readout in the first load beam in response to suspending the first known weight from the lift strap, T21 is a first tension readout in the second load beam in response to suspending the first known weight from the lift strap, T12 is a second tension readout in the first beam in response to suspending the second known weight from the lift strap, and T22 is a second tension readout in the second load beam in response to suspending the second known weight from the lift strap; w1 is a weight of the first known weight, and w2 is a weight of the second known weight; and k1 is the load beam constant for the first load beam and k2 is the load beam constant for the second load beam.

These and additional features provided by the embodiments of overhead lift systems described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1A:
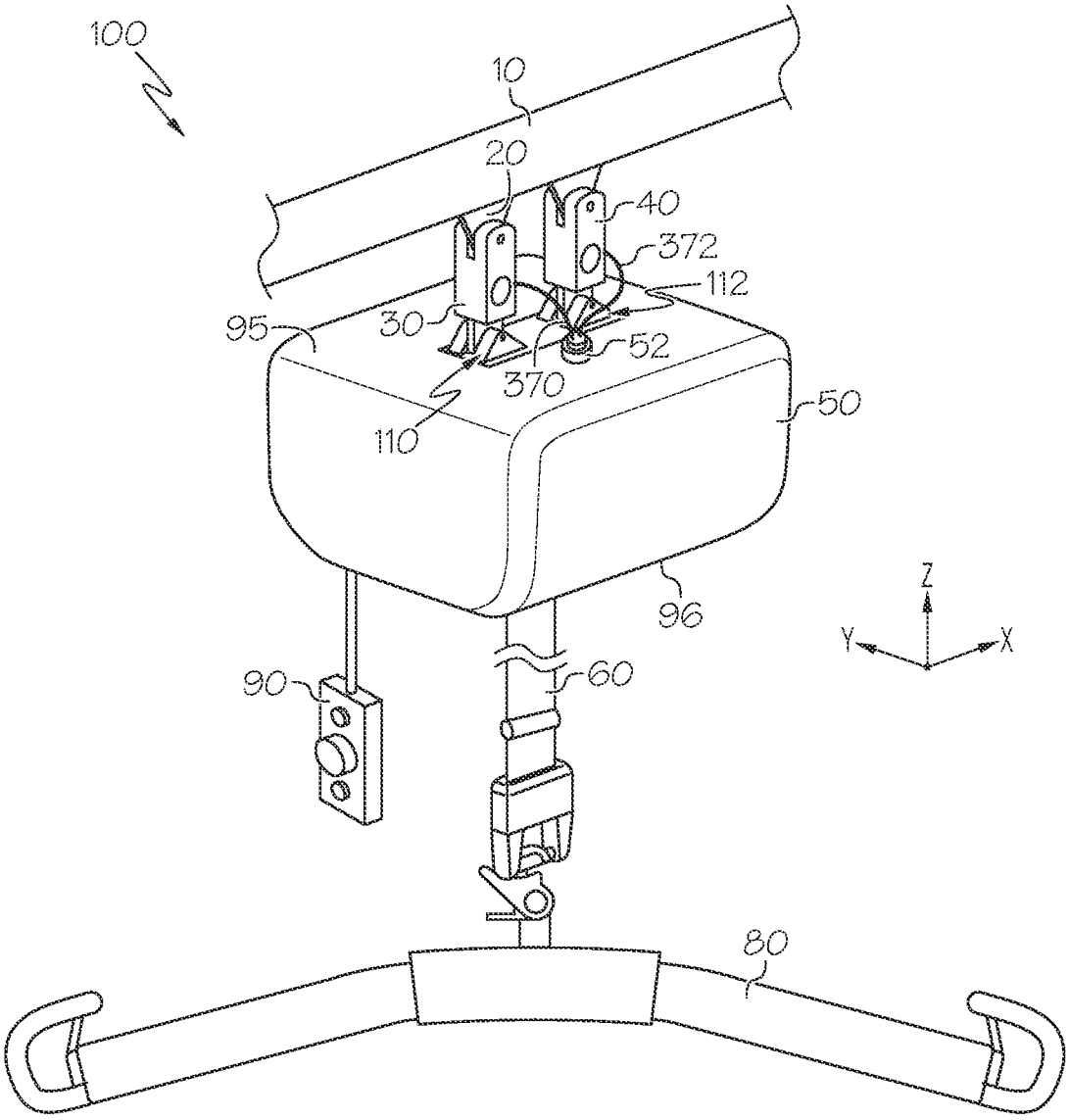
FIG. 1A schematically depicts a perspective view of an overhead lift unit coupled to a rail system, according to one or more embodiments described herein.

Reference will now be made in detail to embodiments of overhead lift units and methods of operating the same, examples of which are illustrated in the accompanying drawings. Whenever possible, the same reference numerals will be used throughout the drawings to refer to the same or like parts.

Embodiments described herein are directed to an overhead lift unit comprising: a carriage, the carriage comprising wheels engageable with a rail; a lift frame coupled to the carriage such that the lift frame is suspended from the carriage; and a pair of load beams. The lift frame comprises a lift strap extending from the lift frame; an actuator coupled to the lift strap, the actuator selectively paying-out and taking up the lift strap; and a pair of connection points extending from the lift frame. Each load beam of the pair of load beams is attached to one connection point of the pair of connection points of the lift frame at an inferior end of the load beam. Each load beam of the pair of load beams is attached to the carriage at a superior end of the load beam. And each load beam of the pair of load beams comprises a strain gauge operable to register a weight supported on the lift strap. Various embodiments of overhead lift units and methods for operating the same will be described herein with specific reference to the appended drawings.

As used herein, the term "longitudinal direction" refers to the forward-rearward direction of the overhead lift unit (i.e., in the +/−x directions of the coordinate axes depicted in the drawings). The term "lateral direction" refers to the cross-direction of the overhead lift unit (i.e., in the +/−y directions of the coordinated axes depicted in the drawings), and is transverse to the longitudinal direction. The term "vertical direction" refers to the upward-downward direction of the subject lift transfer assembly (i.e., in the +/−z directions of the coordinate axes depicted in the drawings), and is transverse to the lateral and the longitudinal directions. The term "superior" refers to the direction toward or placement closer to the rail or ceiling (i.e., in the +z direction of the coordinate axes depicted in the drawings). The term "inferior" refers to the direction toward or placement closer to the sling bar or floor (i.e., in the −z direction of the coordinate axes depicted in the drawings).

As noted herein, overhead lift units may include an actuator, such as an electric motor or the like, that is coupled to a lift strap. The actuator is used to pay-out or take-up the lift strap from the overhead lift unit, thereby raising or lowering a patient from the overhead lift unit. Optionally, the overhead lift unit may further include a motor, sometimes referred to as a "transfer motor" which is coupled to the carriage of the overhead lift unit. The transfer motor may be used to actively position the overhead lift unit and patient along the length of the span of the rail to which the carriage, and hence the overhead lift unit, is attached.

While overhead lift units may be primarily used to assist with lifting patients from, for example, a bed, chair, toilet or the like, overhead lift units may also have a number of secondary functions, such as measuring the weight of the patient supported thereby. Conventionally, this function is provided by utilizing a scale system coupled to the end of the lift strap, between the patient and the lift strap, and below the overhead lift unit. Such conventional scale systems may significantly decrease the range of upward range of travel of the overhead lift unit due to their size and relative position below the overhead lift unit.

In addition, the actuator and transfer motor (when included) of conventional overhead lift units may operate the same regardless of the weight of the subject being lifted and supported with the overhead lift unit. Accordingly some patients, depending on their weight, may be lifted and/or transported along the rail at rates which cause the subject to sway, causing the patient to feel insecure despite being supported by the overhead lift unit.

The embodiments described herein address one or more of the aforementioned issues with conventional overhead lift units. In particular, the overhead lift units described herein include load beams disposed between the carriage of the overhead lift unit and the lift frame of the overhead lift unit. The load beams facilitate determining a weight of a patient supported by the overhead lift unit without significantly encumbering the upward range of travel of the lift strap. In embodiments, the load beams may also facilitate control of the rate at which a patient is lifted by the overhead lift unit and/or control of the rate at which the lift unit is traversed along the rail.

Referring now to FIG. 1A, a perspective view of an overhead lift unit 100 is schematically depicted. The overhead lift unit 100 is engaged with a rail 10. More specifically, wheels of a carriage 20 are engaged with the rail 10. The rail 10 may be, for example and without limitation, an H70, H100, H140, H160, or H180 rail segment available from Liko™ and mounted to a ceiling of a building or the like. At least one load beam extends from a superior portion 480 of a lift frame 400 (depicted in FIG. 4) of the overhead lift unit 100 and couples the lift frame 400 to the carriage 20. In embodiments, a pair of load beams 30, 40 extend from the superior portion 480 of the lift frame 400 (depicted in FIG. 4) of the overhead lift unit 100 and couple the lift frame 400 to the carriage 20. A housing 50 surrounds the lift frame 400 such that connection points 110, 112 of the lift frame 400 that provide attachment points for the load beams 30, 40 extend from a superior surface 95 of the housing 50. The overhead lift unit 100 also includes a lift strap 60 that extends from an inferior surface 96 of the housing 50 through a slot or opening in the housing 50.

Figure 1B:
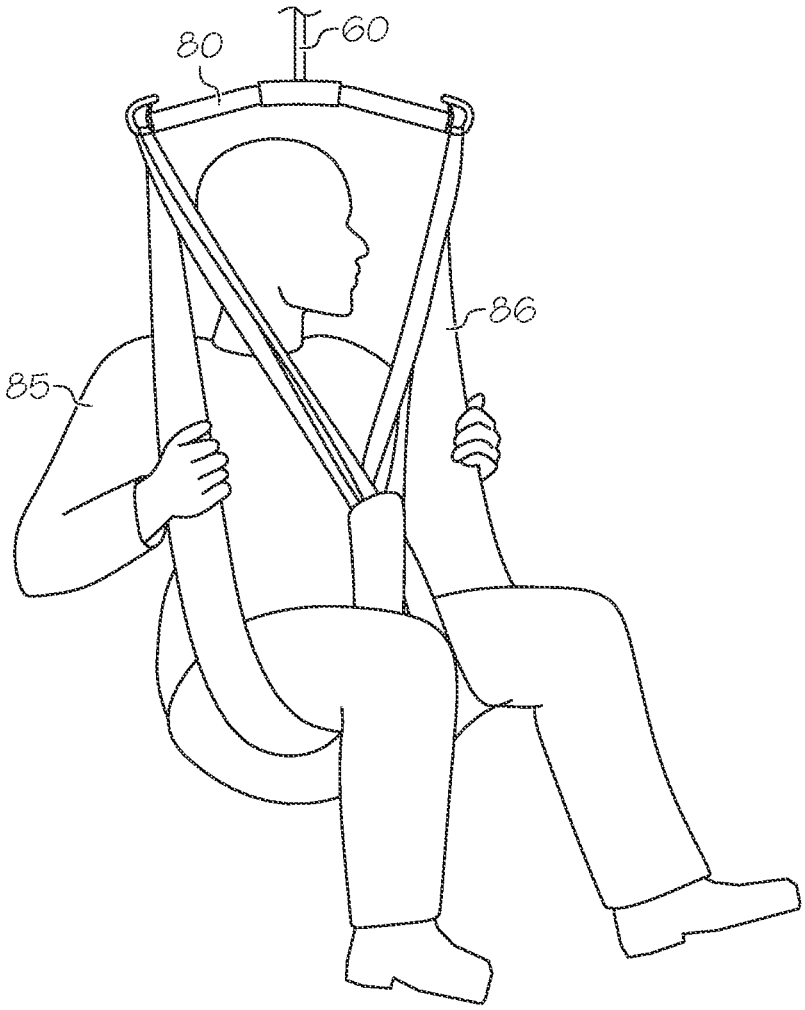
FIG. 1B schematically depicts a perspective view of a patient attached to the sling bar and lift strap of the lift unit of FIG. 1A, according to one or more embodiments described herein.

Referring to FIG. 1A in conjunction with FIG. 1B, a perspective view of a patient 85 attached to the lift strap 60 of the overhead lift unit 100 is depicted. An actuator 450 (depicted in FIG. 4) of the overhead lift unit 100 is disposed within the housing 50 and coupled to the lift frame 400 (depicted in FIG. 4). In embodiments, the actuator 450 may be, for example and without limitation, an electric motor. One end of the lift strap 60 is coupled to the actuator 450 and the opposite end of the lift strap 60 may be selectively coupled to the patient 85, for example, through a sling bar 80 and an accessory coupled to the sling bar 80, such as a sling 86 or the like. Examples of suitable sling bars 80 include, without limitation, the SlingGuard™ series of sling bars available from Liko™. Examples of suitable slings 86 include, without limitation, the ComfortSling™ Plus and ComfortSling™ Plus High available from Liko™. The actuator 450 may take-up the lift strap 60 into the overhead lift unit 100, or pay-out the lift strap 60 from the overhead lift unit 100 to move the patient 85, or subject, upward or downward in the vertical direction. In embodiments, the actuator 450 is communicatively coupled to a hand controller 90, and actuation of the actuator 450 may be controlled via input received by the hand controller 90. In embodiments the hand controller 90 may be a wired controller, as depicted in the drawings. Alternatively, the hand controller 90 may be a wireless controller. In embodiments, the hand controller 90 may include any suitable device for receiving user inputs, such as a graphical user interface (GUI), a push-button controller, a computing terminal, or the like, and may be communicatively coupled to the actuator 450 by any suitable wired or wireless connection.

Figure 2A:
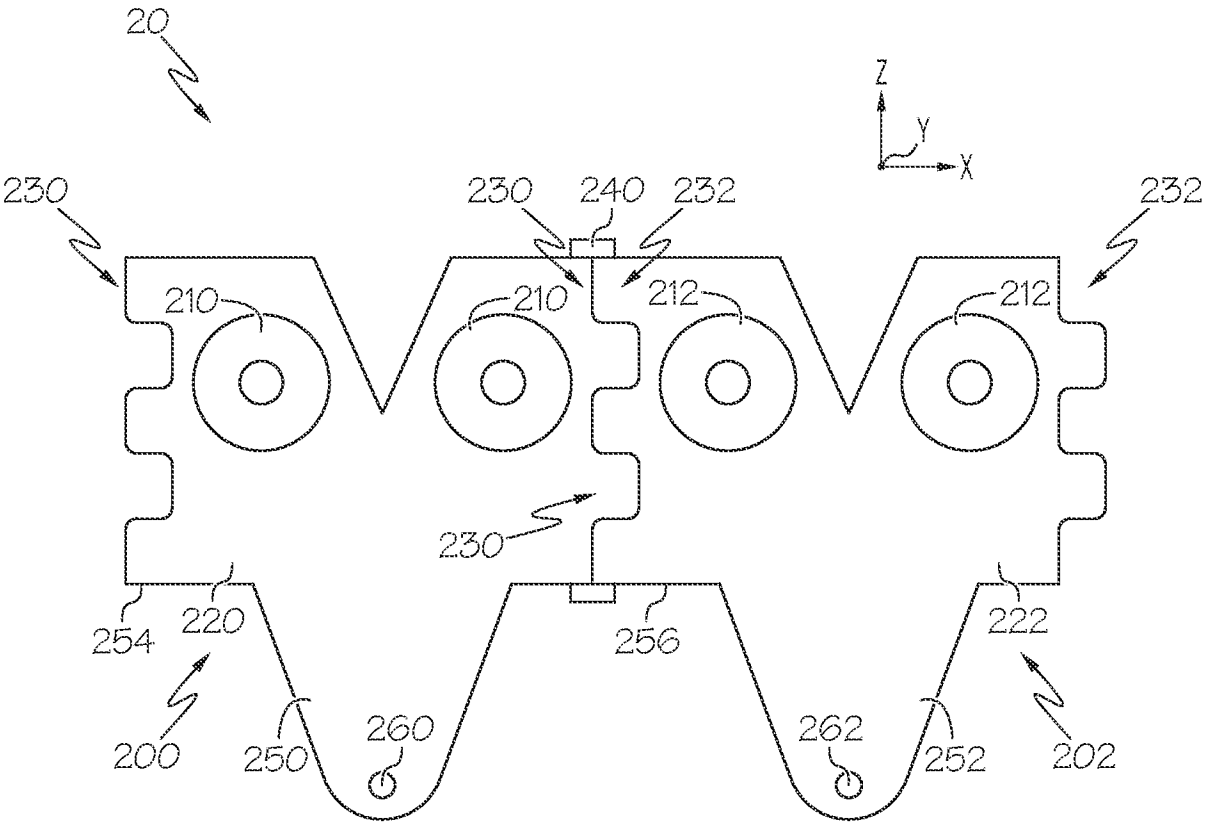
FIG. 2A schematically depicts a side view of a carriage of the overhead lift unit of FIG. 1A, according to one or more embodiments described herein.

Referring now to FIG. 2A, a side view of the carriage 20 is depicted. In embodiments, the carriage 20 may include a first carriage unit 200 and a second carriage unit 202. The first carriage unit 200 includes wheels 210 and the second carriage unit 202 includes wheels 212. The wheels 210 and 212 are designed to engage the rail 10 (depicted in FIG. 1A). The wheels 210 of the first carriage unit 200 are positioned on a lateral face of a truck 220. A second pair of wheels of the first carriage unit 200 may be positioned on an opposite lateral face of the truck 220. While only a pair of wheels 210 are depicted on the lateral face of the truck 220, it should be understood that any number of wheels 210 may be included on the truck 220 of the first carriage unit 200. Similarly, the wheels 212 of the second carriage unit 202 are positioned on a lateral face of a truck 222. A second pair of wheels of the second carriage unit 202 may be positioned on an opposite lateral face of the truck 222. While only a pair of wheels 212 are depicted on the lateral face of the truck 222, it should be understood that any number of wheels 212 may be included on the truck 222 of the second carriage unit 202.

The truck 220 of the first carriage unit 200 includes sets of hollow knuckles 230 at its longitudinal ends (in the +/−x direction of the coordinate axes of FIG. 2A). The truck 222 of the second carriage unit 202 also includes sets of hollow knuckles 232 at its longitudinal ends (in the +/−x direction of the coordinate axes of FIG. 2A). The first and second carriage units 200, 202 may be arranged such that a forward set of hollow knuckles 230 of the first carriage unit 200 interlace with a rearward set of hollow knuckles 232 of the second carriage unit 202. For instance, the set of knuckles 230 disposed on the truck 220 in the forward direction (the +x direction of the coordinate axes of FIG. 2A) may interlace with the set of knuckles 232 disposed on the truck 222 in the rearward direction (the −x direction of the coordinate axes of FIG. 2A). The interlaced sets of knuckles 230 and 232 may be secured with a pin 240, thereby hingedly securing the truck 220 of the first carriage unit 200 with the truck 222 of the second carriage unit 202. The hinge connection between the carriage units 200, 202 allow both carriage units 200, 202 to rotate about the pin 240. Such rotation allows the carriage 20 to smoothly traverse a curved or rounded portion of the rail 10 (depicted in FIG. 1A).

Still referring to FIG. 2A, the truck 220 of the first carriage unit 200 of the carriage 20 may include a connection point 250. The connection point 250 may extend from an inferior portion 254 of the truck 220 (in the −z direction of the coordinate axes of FIG. 2A). The connection point 250 may be a tab or other structure integrally formed with or attached to the truck 220. The connection point 250 may include a throughbore 260 for receiving one or more fixation devices, such as a pin, rod, or screw. Similarly, the truck 222 of the second carriage unit 202 of the carriage 20 may include a connection point 252. The connection point 252 may extend from an inferior portion 256 of the truck 222. The connection point 252 may be a tab or other structure integrally formed with or attached to the truck 222. The connection point 252 may include a throughbore 262 for receiving one or more fixation devices, such as a pin, rod, or screw. The connection points 250, 252 may mate or connect with corresponding connection points or regions of the lift frame 400 (depicted in FIG. 4) of the overhead lift 100 (depicted in FIG. 1A). The connection points 250, 252 may also mate or connect with corresponding points or regions of load beams 30, 40 (depicted in FIG. 1A). For instance, the connection points 250, 252 may be received in a corresponding clevis 320 of a load beam (depicted in FIG. 3) and secured to the corresponding clevis 320 with pins received through the throughbores 260, 262. While the connection points 250, 252 are depicted as tabs in FIG. 2A, it should be understood that other embodiments are contemplated and possible, such as embodiments where the connection points 250, 252 are clevis connectors for mating with corresponding tabs of the load beams 30, 40.

Figure 2B:
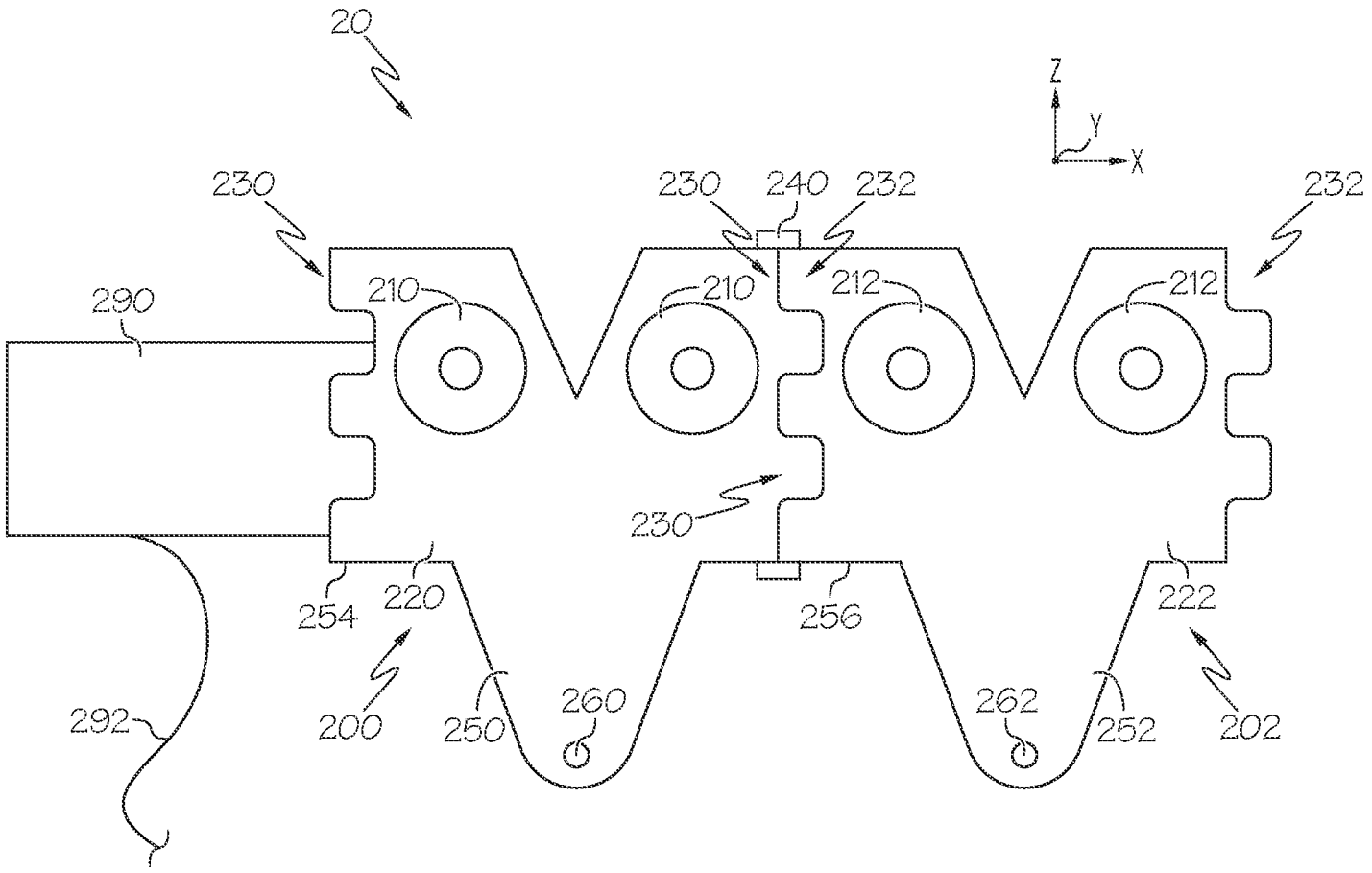
FIG. 2B schematically depicts a side view of a carriage of the overhead lift unit of FIG. 1A including a transfer motor, according to one or more embodiments described herein.

Referring now to FIG. 2B, a side view of an alternative embodiment of the carriage 20 is depicted. In embodiments, the overhead lift unit 100 (depicted in FIG. 1A), and specifically the carriage 20, may optionally include a transfer motor 290. The transfer motor 290 may be coupled to one or more of the wheels 210, 212 of the carriage 20 such that one or more of the wheels 210, 212 are actively driven by the transfer motor 290. In this embodiment, the carriage 20, and therefore the overhead lift unit 100, may be driven along the rail 10 (depicted in FIG. 1A) with the transfer motor 290. The transfer motor 290 may be communicatively coupled to the hand controller 90 (depicted in FIG. 1A), and actuation of the transfer motor 290 may be controlled via input received by the hand controller 90. The transfer motor 290 may include an electrical interconnect 292 that electrically and/or communicatively couples the transfer motor 290 to one or more electrical components of the overhead lift unit 100, such as an electronic control unit 454 and/or a battery 456 (depicted in FIG. 4). In other embodiments, such as the embodiment depicted in FIG. 2A, the wheels 210, 212 of the carriage 20 may be passively driven along the rail 10.

Figure 3:
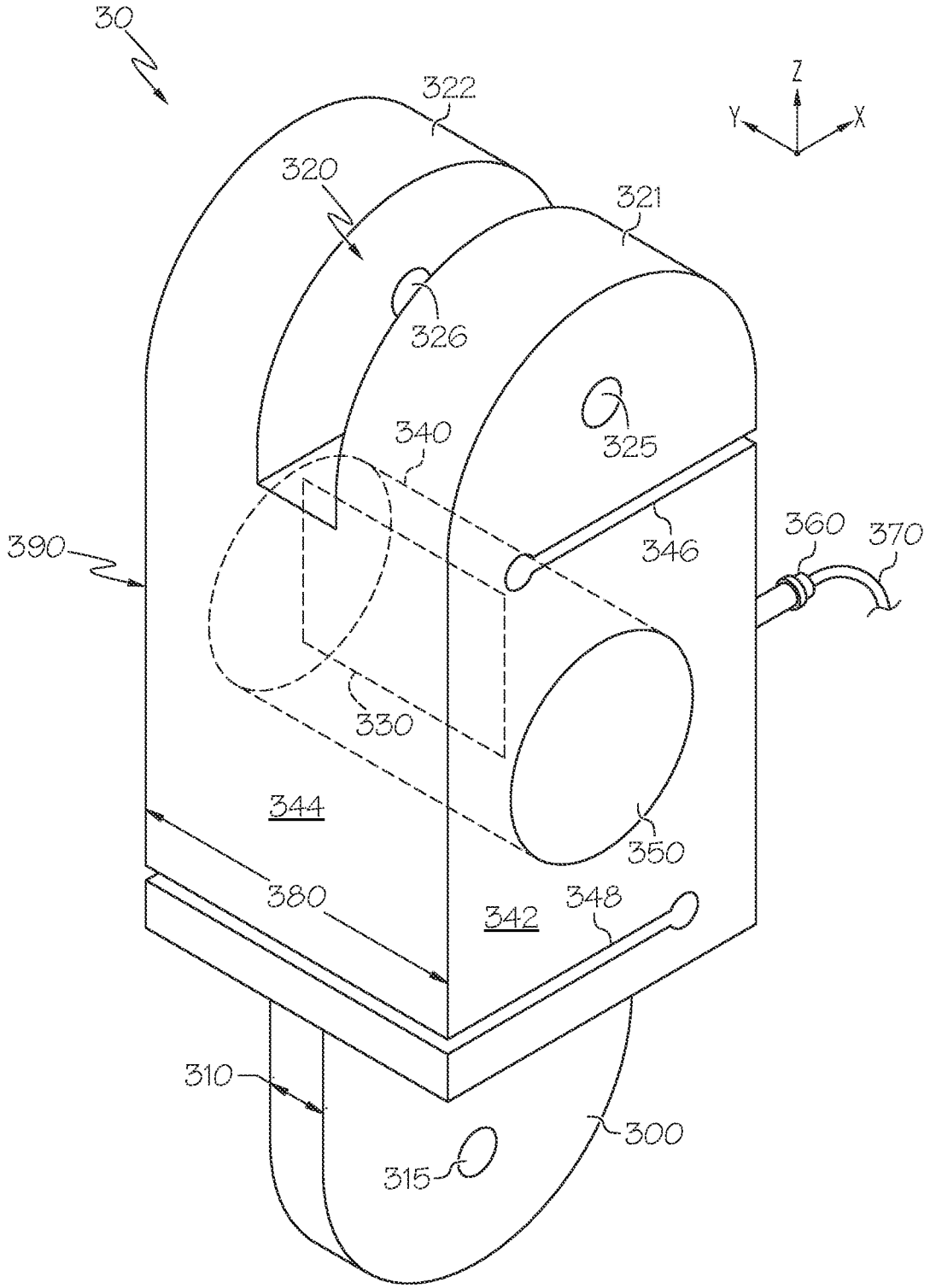
FIG. 3 schematically depicts a perspective view of a load beam of the overhead lift unit of FIG. 1A, according to one or more embodiments described herein.

Referring now to FIG. 3, a perspective view of the load beam 30 is depicted. While the load beam 30 will be described in detail, it should be appreciated that the following description may equally apply to the load beam 40 (depicted in FIG. 1A). The load beam 30 may generally comprise a body 390 and a tab 300. A clevis 320 may be positioned at the superior end (in the +z direction of the coordinate axes of FIG. 3) of the body 390. The clevis 320 may be formed by two clevis prongs 321, 322 that are integral with the body 390 of the load beam 30. The clevis prongs 321, 322 may include aligned throughbores 325, 326. The clevis prong 321 may include the throughbore 325, and the clevis prong 322 laterally opposite (in the +y direction of the coordinate axes of FIG. 3) the clevis prong 321 may include the throughbore 326 aligned with the throughbore 325. While the clevis 320 and clevis prongs 321, 322 are depicted as arcuate in shape, it should be appreciated that the clevis 320 and clevis prongs 321, 322 may take any desirable shape, such as rectangular, triangular, or the like. The clevis 320 (in the +/−y direction of the coordinate axes of FIG. 3) is sized to receive one of the connection points 250, 252 (depicted in FIGS. 2A, 2B) of the carriage 20. In other words, the connection point 250 and the connection point 252 may be individually received within the clevis 320 of a corresponding load beam. The connection point 250 of the carriage 20, for instance, may then be secured within the clevis 320 by a pin extending through the throughbore 325 of the clevis prong 321, the throughbore 260 of the connection point 250 of the carriage 20, and the throughbore 326 of the clevis prong 322 thereby pivotably securing the load beam 30 to the connection point 250 of the carriage 20.

The body 390 of the load beam 30 may include a pair of lateral faces, including face 342 and the face opposite face 342 in the +y direction of the coordinate axes of FIG. 3, and a pair of longitudinal faces, including face 344 and the face opposite face 344 in the +x direction of the coordinate axes of FIG. 3. An aperture 340 may extend between the pair of lateral faces. In other embodiments, the aperture 340 may extend between the pair of longitudinal faces. The aperture 340 may completely traverse a pair of faces and, therefore, extend throughout an entire width 380 of the body 390. In other embodiments, the aperture 340 may only partially extend, for instance, from the face 342 partially through the body 390. In such embodiments, the aperture 340 may not extend through the entire width 380 of the body 390.

The load beam 30 may include a strain gauge 330 within the aperture 340. The strain gauge 330 may also be referred to as a load sensor or a force-sensitive resistor. The strain gauge 330 is operable to register a weight transferred through the load beam 30, as will be described in more detail herein. In embodiments, the load beam 30 may include multiple strain gauges 330 in the aperture 340. The strain gauges 330 may be positioned flat on the interior surfaces of the aperture 340. The one or more open ends of the aperture 340 may be potted. In other words, if the aperture 340 traverses the entire width 380 of the body 390 between the pair of lateral faces, each lateral face, such as face 342, may include a potting material 350 that fills and seals the aperture 340. The potting material 350 may be rubber, plastic, or any other suitable material that seals the aperture 340 and prevents the strain gauge 330 from experiencing any external forces not transferred to the load beam 30 by a weight supported on the lift strap 60 (depicted in FIGS. 1A and 1B), for example. The load beam 30 may be configured as an "S-beam," as depicted in FIG. 3. As such, the load beam 30 may include s-cut 346 and s-cut 348, which allow tensile forces, such as the weight of a patient 85 attached to the lift strap 60 (depicted in FIG. 1B), to be transmitted to the body 390 of the load beam 30 between the s-cut 346 and the s-cut 348. Accordingly, the body 390 between the s-cut 346 and the s-cut 348, including the aperture 340, may strain based on the magnitude of tensile forces transmitted to the load beam 30. The strain gauge 330 may measure the strain in the load beam 30 and readout the strain as a load or weight of a patient 85 supported on the lift strap 60.

Still referring to FIG. 3, the load beam 30 may further include a strain relief connector 360. The strain relief connector 360 may extend from the aperture 340 through a face of the body 390 of the load beam 30. In some embodiments, the strain relief connector 360 may extend from a face of the pair of faces orthogonal to the aperture 340. In other words, if the aperture 340 extends between the lateral faces, including face 342 and the face opposite face 342 in the +y direction of the coordinate axes of FIG. 3, of the load beam 30, the strain relief connector 360 may extend from one of the longitudinal faces, such as face 344 and/or the face opposite face 344 in the +x direction of the coordinate axes of FIG. 3, of the load beam 30. The strain relief connector 360 accepts one or more electrical interconnects, such as electrical interconnect 370, coupled to the strain gauge 330. Accordingly, the electrical interconnect 370 may extend from the strain gauge 330 within the aperture 340 and through the strain relief connector 360 to one or more electrical components of the overhead lift unit 100 (depicted in FIG. 1A).

Still referring to FIG. 3, the load beam 30 also includes tab 300. The tab 300 may be positioned at an inferior end (in the −z direction of the coordinate axes of FIG. 3) of the load beam 30. The tab 300 may extend from the inferior end (in the −z direction of the coordinate axes of FIG. 3) of the body 390 of the load beam 30 opposite the clevis 320. The tab 300 includes a tab width 310 that is less than the width 380 of the body 390. While the tab 300 is depicted as having an arcuate shape, it should be understood that the tab 300 may have other shapes, such as rectangular or triangular. The tab 300 includes a throughbore 315. The distance between the throughbore 315 and the throughbores 325, 326 through the clevis 320 is minimized to reduce the length (in the +/−z direction of the coordinate axes of FIG. 3) of the load beam 30, and more specifically, to reduce the additional length between the carriage 20 (depicted in FIGS. 2A and 2B) and a clevis 110, 112 of the lift frame 400 (depicted in FIG. 4), as will be described further herein.

In the embodiments of the load beams 30, 40 depicted herein, the load beams 30, 40 are described as including a clevis 320 at a superior end (in the +z direction of the coordinate axes of FIG. 3) and a tab 300 at an inferior end (in the −z direction of the coordinate axes of FIG. 3) for mating with a corresponding connection point or tab 250, 252 of the carriage 20 (depicted in FIGS. 2A and 2B) and a corresponding clevis 110, 112 of the lift frame 400 (depicted in FIG. 4), respectively. However, it should be understood that other embodiments are contemplated and possible. For example, the load beams 30, 40 may have a tab at the superior end and a clevis at the inferior end. In such embodiments, the connection points 250, 252 of the carriage 20 may be clevis connections for coupling with tabs at the superior ends of the load beams 30, 40 and the lift frame 400 may include tabs for mating with the clevis connections at the inferior ends of the load beams 30, 40.

Figure 4:
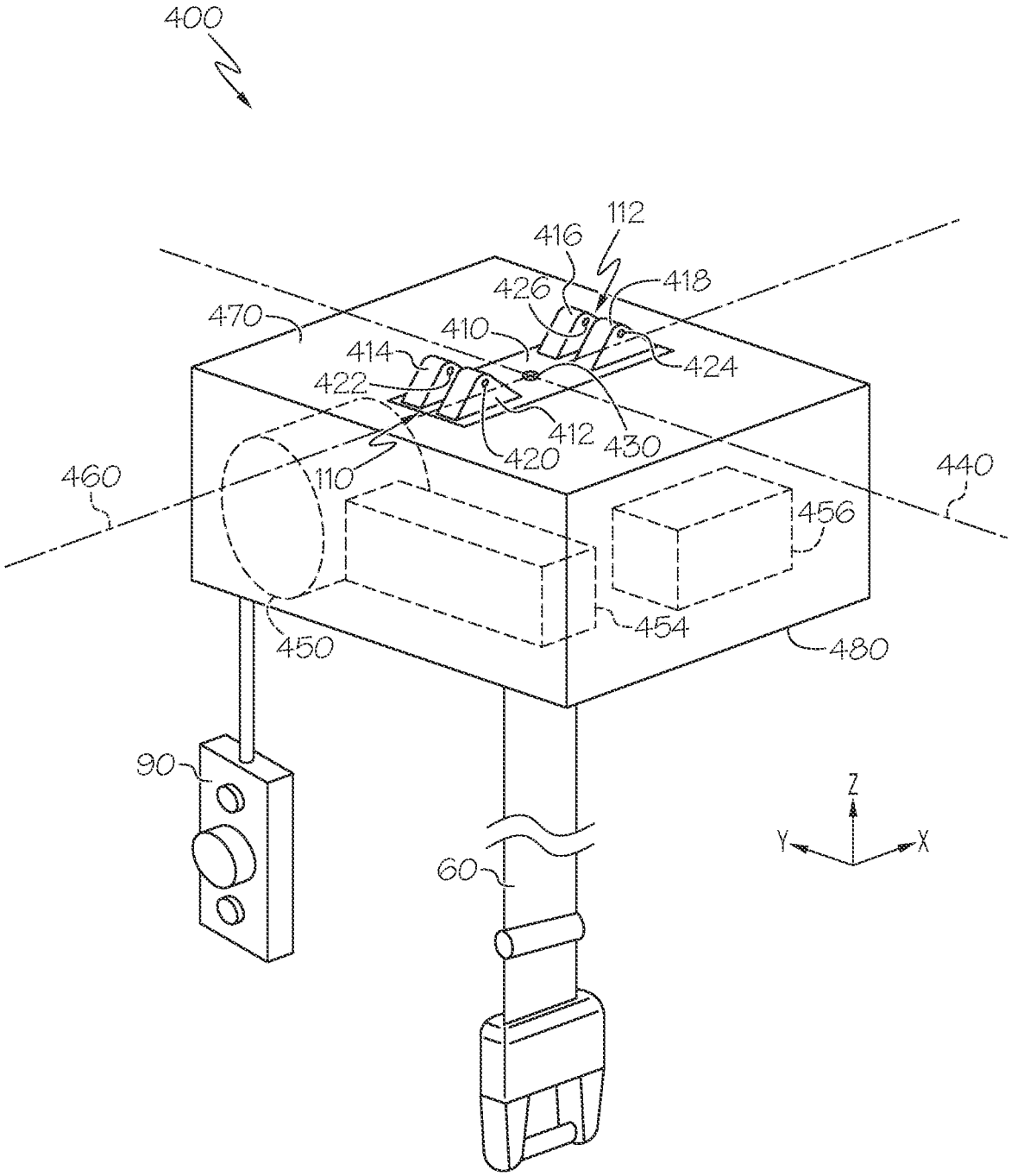
FIG. 4 schematically depicts a perspective view of a lift frame of the overhead lift unit of FIG. 1A, according to one or more embodiments described herein.

Referring now to FIG. 4, a perspective view of a lift frame 400 is depicted. The lift frame 400 includes a connection plate 410 at a superior portion 470 (in the +z direction of the coordinate axes of FIG. 4) of the lift frame 400. The connection points 110 and 112 extend from the connection plate 410. The connection points 110 and 112 may be devises, as depicted in FIG. 4. The connection point 110, or clevis, may include a clevis prong 412 and a clevis prong 414. The clevis prong 412 may include a throughbore 420, and the clevis prong 414 may include a throughbore 422. The connection point 112, or clevis, may include a clevis prong 416 and a clevis prong 418. The clevis prong 416 may include a throughbore 426, and the clevis prong 418 may include a throughbore 424. The distance between the clevis prongs 412, 414 (in the +/−y direction of the coordinate axes of FIG. 4) is sized to receive the tab 300 of the load beam 30 (depicted in FIG. 3) or the connection points 250, 252 of the carriage 20 (depicted in FIGS. 2A and 2B). For example, the tab 300 of the load beams 30, 40 may be received within the connection points 110 and 112 of the connection plate 410. With specific reference to connection point 110, for instance, the tab 300 of load beam 30 may be received within the clevis prongs 412 and 414 of the connection point 110. The tab 300 of the load beam 30 may then be secured within the connection point 110 by a pin or other securement device inserted through the throughbores 420, 422, and 315 (depicted in FIG. 3). The tab 300 of the load beam 30 may be sized such that it is pivotably secured within the connection point 110. The load beam 40 (depicted in FIG. 1A) may be coupled to the connection point 112 in a similar manner. While the connection points 110, 112 are depicted as clevis connections in FIG. 4, it should be understood that other embodiments are contemplated and possible, such as embodiments where the connection points 110, 112 are tabs for mating with corresponding clevis connectors of the load beams 30, 40.

Still referring to FIG. 4, the lift strap 60 may extend from an opening in an inferior portion 480 (in the −z direction of the coordinate axes of FIG. 4) of the lift frame 400. In embodiments, the lift strap 60 extends from the lift frame 400 at a position at or below a center of mass 430 of the lift frame 400. While the point 430 will be described herein as the "center of mass" of the lift frame 400, it should be appreciated that the true center of mass is within the interior of the lift frame 400. The point 430 is vertically aligned with the true center of mass in the both the longitudinal and lateral directions (i.e. the point 430 shares the same x-y coordinates as the true center of mass). However, the point 430 is vertically offset from the true center of mass, and is displayed on the superior portion 470 of the lift frame 400 only for ease of illustration. The connection points 110 and 112 may be equidistantly spaced from the center of mass 430 of the lift frame 400, and therefore equidistantly spaced from the lift strap 60. The connection points 110 and 112 may also be symmetrically arranged from the center of mass 430 about a lateral centerline 440 extending through the center of mass 430. Accordingly, when the load beams 30 and 40 (depicted in FIG. 1A) are attached to the connection points 110 and 112, the load beams 30 and 40 may also be equidistantly and symmetrically spaced from the center of mass 430. The connection points 110 and 112 may also be positioned on a longitudinal centerline 460 extending through the center of mass 430. Accordingly, when the load beams 30 and 40 are attached to the connection points 110 and 112, the load beams 30 and 40 may be positioned on the longitudinal centerline 460 extending through the center of mass 430. In some embodiments, lift strap 60 extends from the lift frame 400 at a position offset from (in the direction of the x-axis and/or y-axis of the coordinate axes of FIG. 4) center of mass 430 of the lift frame 400. In some embodiments, the connection points 110 and 112 may be asymmetrically arranged from the center of mass 430 about the lateral centerline 440 extending through the center of mass 430 and/or offset from the longitudinal centerline 460 extending through the center of mass 430. Accordingly, in some embodiments the load beams 30 and 40 (depicted in FIG. 1A), when attached to the connection points 110 and 112 may be asymmetrically spaced from the center of mass 430. Moreover, in some embodiments, the load beams 30 and 40 may be offset from the longitudinal centerline 460 extending through the center of mass 430.

As noted herein, the lift frame 400 includes an actuator 450 that operates to selectively take-up or pay-out the lift strap 60 with respect to the lift frame 400. The lift frame may also include the electronic control unit 454 and the batter 456. The battery 456 may be disposed in the lift frame 400 and electrically coupled to the electronic control unit 454, the actuator 450, and the transfer motor 290 (when included), thereby providing power to these components. The electronic control unit 454 may be communicatively coupled to the hand controller 90 and operable to receive an input from an operator via the hand controller 90. The hand controller 90 may include a wired and/or one or wireless connections to the electronic control unit 454. Based on the input received from the hand controller 90, the electronic control unit 454 may be programmed to adjust the position of the lift strap 60 and/or the carriage 20 (depicted in FIGS. 2A and 2B) by sending electric control signals to the actuator 450 and/or transfer motor 290. Alternatively, the lift frame 400 may not include a battery such as in embodiments where the overhead lift unit 100 is directly wired to a power source such as through the rail or the like.

Referring to FIG. 1A, FIG. 1B, and FIG. 4, the housing 50 surrounds and at least partially encloses the lift frame 400. The housing 50 includes an opening in the superior surface 95 that aligns with at least a portion of the connection plate 410, such that the connection points 110 and 112 extend upwardly (in the +z direction of the coordinate axes of FIG. 1A) from the housing 50. Accordingly, the connection points 110 and 112 of the lift frame 400 extend from the housing 50 to allow for connection of the load beams 30, 40 and/or the carriage 20 (depicted in FIGS. 2A and 2B) to the lift frame 400. The housing 50 also includes grommet 52 in the superior surface 95. The grommet 52 accepts electrical interconnects 370 and 372 from the load beams 30 and 40, respectively. More specifically, with reference to the load beam 30, the electrical interconnect 370 extends from the strain gauge 330 and through the strain relief connector 360 (depicted in FIG. 3). The electrical interconnect 370 may then extend through the grommet 52 of the housing 50, such that the electrical interconnect 370 engages or connects with one or more electrical components of the lift frame 400 disposed within the housing 50. For example, the electrical interconnect 370 may couple with the electronic control unit 454 and/or the battery 456. In embodiments, the electrical interconnect 370 is connected to the battery 456 through the electronic control unit 454. The housing 50 also includes an inferior slot or opening in the inferior surface 96 through which the lift strap 60 extends, thereby allowing the lift strap 60 to be taken-up or paid-out freely from the lift frame 400 and housing 50.

Figure 5:
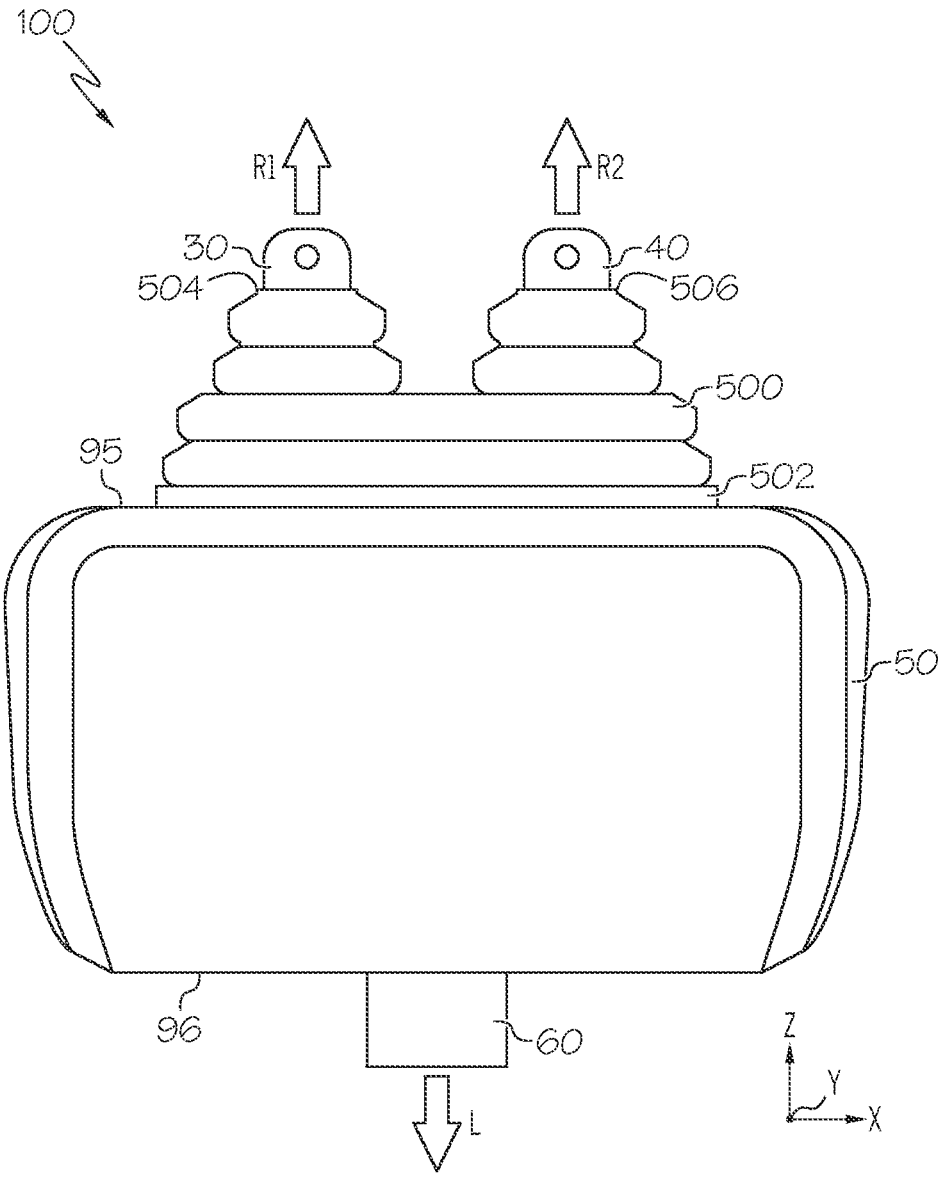
FIG. 5 depicts a side view the overhead lift unit of FIG. 1A including a boot, according to one or more embodiments described herein.

Referring now to FIG. 5, a side view of the overhead lift unit 100 comprising a boot 500 is depicted. The boot 500 attaches to the superior surface 95 of the housing 50 at a bezel 502. The bezel 502 may be plastic or any other material that allows for secure attachment between the boot 500 and the bezel 502. The boot 500 may be secured to the bezel 502 with screws, bolts, or other desirable securement devices. The boot 500 surrounds the load beams 30 and 40. In embodiments, the boot 500 may comprise a stepped design, as depicted in FIG. 5, that includes a non-contacting region between the boot 500 and the load beams 30, 40. In other words, a volume or spacing is maintained between the boot 500 and the load beams 30, 40, from the connection point of the boot 500 at the bezel 502 to the distal (in the +z direction of the coordinate axes of FIG. 5) edge of the boot 500, which includes boot openings 504 and 506. The boot opening 504 and 506 allow passage of the load beams 30 and 40, respectively, through the boot 500. More specifically, the boot openings 504 and 506 may contact the load beams 30 and 40, respectively, around the outer perimeters of the load beams 30 and 40 beneath the clevis 320 (depicted in FIG. 3) of each load beam 30, 40. Accordingly, the clevis 320 of each load beam 30 and 40 may remain exposed to allow for connection to the carriage 20 (depicted in FIGS. 2A and 2B). The boot 500 is made of a compliant material, such as, but not limited to, vinyl, silicone, or the like, that is compliant and allows the boot to sustain multiple washing or cleaning treatments, such as with heat, detergent, or the like, without impacting the structure of the boot 500. The boot 500 may be constructed to have a specified compliance that provides the boot 500 with both sufficient flexibility and stiffness. For instance, the boot 500 may maintain a desirable flexibility to allow the boot 500 to effectively navigate curves in the rail 10 (depicted in FIG. 1A). The material and stepped shaped of the boot 500 provides sufficient flexibility to absorb incidental forces experienced by the overhead lift unit 100. In contrast, a rigid boot may transmit such forces to the load beams 30 and 40, potentially compromising the readings from the strain gauges 330 (depicted in FIG. 3) in the load beams 30, 40. The boot 500 may also exhibit a desirable stiffness to prevent rotation of the load beams 30, 40 while attaching the load beams 30, 40 to the carriage 20 (depicted in FIGS. 2A and 2B), as will be described in more detail herein.

As discussed above, the lift strap 60 may extend from the center of mass 430 of the lift frame 400 (depicted in FIG. 4) and the load beams 30, 40, when attached to the connection points 110 and 112, may be positioned on the longitudinal centerline 460 passing through the center of mass 430 and equidistantly and symmetrical spaced from the lateral centerline 440 passing through the center of mass 430. Accordingly, in such embodiments, the overhead lift unit 100 is fundamentally balanced such that a weight L attached to the lift strap 60 is transferred to the load beams 30 and 40 as reaction forces R1 and R2, respectively. In other words, the sum of R1 and R2, in all cases, equals the weight L. If the weight L on the lift strap 60 is swaying for instance, R1 may not equal R2. However, the balance between the lift strap 60 and the load beams 30, 40 may be such that the sum of the reaction forces R1 and R2 still equal the weight L. Accordingly, the strain gauges 330 (depicted in FIG. 3) in the load beams 30, 40 may accurately detect or measure a weight of a patient 85 (depicted in FIG. 1B) attached to the lift strap 60. Furthermore, and as will be discussed in greater detail below, the balance between the lift strap 60 and the load beams 30, 40 may be such that a method of calibrating the overhead lift unit 100 is simplified.

As discussed above, the load beams 30, 40 (depicted in FIG. 1A) may be modular components from the rest of the overhead lift unit 100 and may be selectively attached or incorporated with the overhead lift unit 100. For instance, with reference to FIGS. 2 and 4, the lift frame 400 may be directly attached to the carriage 20. More specifically, the connection point 250 of the first carriage unit 200 of the carriage 20 and the connection point 252 of the second carriage unit 202 of the carriage 20 may respectively be received and attached in the connection points 110 and 112 of the lift frame. A first pin or other securement device may pass through the throughbores 420, 260, and 422, for instance, and a second pin or other securement device may pass through the throughbores 424, 262, and 426. If a user wishes to implement the load beams 30, 40 with the overhead lift unit 100, the user may remove the pins or other device securing the first and second carriage units 200, 202 with the connection points 110, 112. Accordingly, the user may remove the lift frame 400 and housing 50 (depicted in FIG. 1A) from the carriage 20. The carriage 20 may be left engaged with the rail 10 (depicted in FIG. 1A).

The load beams 30, 40 may then be attached to the connection points 110 and 112. More specifically, and with additional reference to the load beam 30 depicted in FIG. 3, the tab 300 of the load beam 30 may be inserted into the connection point, or clevis, 110 of the lift frame 400. The aligned throughbores 420 and 422 of the connection point 110 and throughbore 315 of the tab 300 may receive a pin, rod, or other securement device that pivotably attaches the load beam 30 to the connection point 110. The load beam 40 may be similarly pivotably attached to the connection point 112. The electrical interconnect 370 of the strain gauge 330 of the load beam 30, passing through the strain relief connector 360, may be fed through the grommet 52 of the housing 50 (depicted in FIG. 1A). Accordingly, the electrical interconnect 370 may be secured to one or more components of the lift frame 400 or otherwise within the housing 50. For instance, the strain gauge 330, via the electrical interconnect 370, may be coupled to the electronic control unit 454. The electrical interconnect 372 of the load beam 40 may be similarly received through the grommet 52 and coupled to one or more electrical components of the overhead lift unit 100 (depicted in FIG. 1A).

Referring now to FIGS. 2, 3, 4, and 5, following the pivotable attachment of the load beams 30, 40 to the connection points 110, 112, the boot 500 may be attached to the bezel 502. In attaching the boot 500 to the bezel 502, the load beams 30, 40 may be inserted through the boot openings 504, 506, respectively. By inserting the load beams 30, 40 through the boot openings 504, 506, the devises of the load beams 30, 40, such as clevis 320, may extend out of the boot 500. The boot 500 may be stiff enough such that the contact between the boot openings 504, 506 and the load beams 30, 40 may help maintain the load beams 30, 40 in an upright position. In other words, the boot 500 may make it possible for a user to grip the exposed portions of the load beams 30, 40 and lift the lift frame 400 and housing 50 toward the carriage 20 without the load beams 30, 40 pivoting about the connection points 110, 112. Accordingly, the user may raise the lift frame 400 and housing 50 toward the rail 10 (depicted in FIG. 1A) to attach the load beams 30, 40 to the carriage 20. More specifically, with reference to load beam 30, the connection point 250 of the first carriage unit 200 may be received within the clevis 320, and a pin, rod, or other securement device may be inserted through the throughbores 325 and 326 of the clevis 320, and the throughbore 260 of the first carriage unit 200. Accordingly, the load beam 30 may be pivotably attached to the first carriage unit 200 of the carriage 20. The load beam 40 may be similarly pivotably attached to the second carriage unit 202 of the carriage 20. In this manner, the overhead lift unit 100 is securely coupled to the load beams 30, 40 such that the load beams 30, 40 allow for measurement of a weight supported on the lift strap 60, such as the weight of the patient 85 (depicted in FIG. 1B), and the pivotable load beams 30, 40 along with the hinged carriage 20 provide the necessary degrees of freedom for the overhead lift unit 100 to navigate curves or bends in the rail 10 (depicted in FIG. 1A).

In the embodiments described herein, the lifting range of the overhead lift unit 100 is reduced only by the distance between the throughbores of the clevis, such as throughbores 325 and 326, and the throughbore of the tab, such as throughbore 315, of the load beams 30, 40. In embodiments, the distance may be 75 mm or less. In contrast, conventional scale assemblies that attach between the lift strap and a sling bar or lifting apparatus for a patient often reduce the lifting range of overhead lifts by 200 mm or more, which may cause significant difficulties in facilities where the overhead rail is attached to a low ceiling.

Figure 6:
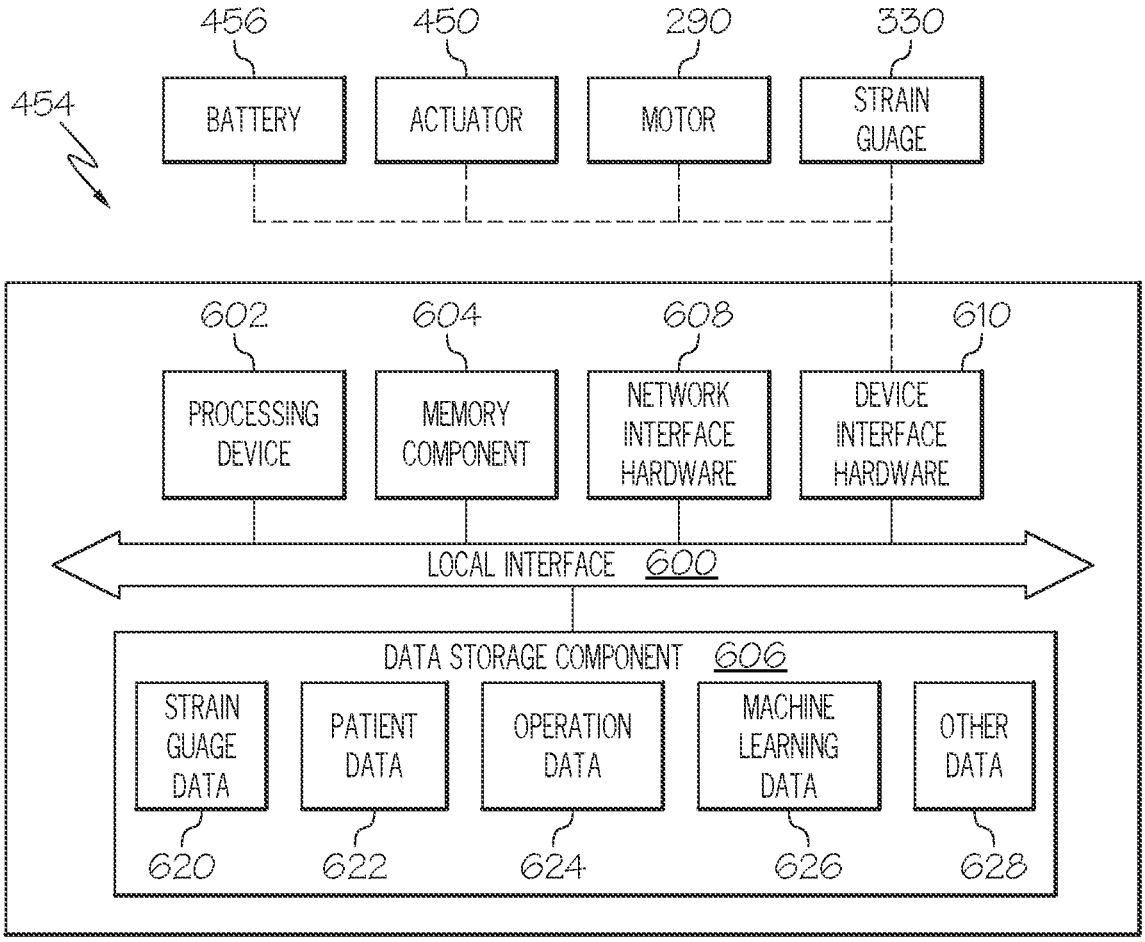
FIG. 6 schematically depicts the electrical interconnectivity of the various components of the rail-mounted lift system of FIG. 1A.

Referring now to FIGS. 4 and 6, the interconnectivity of the various electrical components of the overhead lift unit 100 (depicted in FIG. 1A) is schematically depicted. Particularly, FIG. 6 depicts various system components for determining a weight, such as a weight of the patient 85 (depicted in FIG. 1B), attached to the lift strap 60, and controlling the operation of the overhead lift unit 100 accordingly.

As illustrated in FIG. 6, the electronic control unit 454 may include one or more processing devices 602, a non-transitory memory component 604, network interface hardware 608, device interface hardware 610, and a data storage component 606. A local interface 600, such as a bus or the like, may interconnect the various components.

The one or more processing devices 602, such as a computer processing unit (CPU), may be the central processing unit of the electronic control unit 454, performing calculations and logic operations to execute a program. The one or more processing devices 602, alone or in conjunction with the other components, are illustrative processing devices, computing devices, processors, or combinations thereof. The one or more processing devices 602 may include any processing component configured to receive and execute instructions (such as from the data storage component 606 and/or the memory component 604).

The memory component 604 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. The memory component 604 may include one or more programming instructions thereon that, when executed by the one or more processing devices 602, cause the one or more processing devices 602 to complete various processes.

Still referring to FIG. 6, the programming instructions stored on the memory component 604 may be embodied as a plurality of software logic modules, where each logic module provides programming instructions for completing one or more tasks. Each of the logic modules may be embodied as a computer program, firmware, or hardware, as an example. Illustrative examples of logic modules present in the memory component 604 include, but are not limited to, data receiving logic, data analysis logic, speed determination logic, pulse width modulation logic, and device interface logic.

The data receiving logic includes one or more programming instructions for receiving data from the one or more strain gauges 330 (depicted in FIG. 3) of each load beam 30, 40 (depicted in FIG. 1A). That is, the data receiving logic may create a connection between the device interface hardware 610 and the strain gauges 330 of the load beams 30, 40 such that data gathered by the strain gauges 330 is received by the electronic control unit 454. Further, the data collected by the strain gauge 330 may be stored (e.g., within the data storage component 606). The data receiving logic may also receive data from the actuator 450, transfer motor 290, and the battery 456.

The data analysis logic includes one or more programming instructions for analyzing data received by the data receiving logic and the device interface hardware 610. That is, the data analysis logic contains programming for analyzing the data collected by the strain gauge 330 (depicted in FIG. 3) and determining the weight supported on the lift strap 60, such as the weight of the patient 85 (depicted in FIG. 1B). As explained above, the summation of the reaction forces experienced in the load beams 30, 40 (depicted in FIG. 1A) may be equal to the weight on the lift strap 60. A user or caregiver may zero the system by selecting a zeroing feature on the hand controller 90, for instance. Accordingly, the system may be zeroed after a sling bar 80 (depicted in FIGS. 1A and 1B) or other attachment device, such as sling 86 (depicted in FIG. 1B) is attached to the lift strap 60, ensuring the readout from the strain gauges 330 is not influenced by such hardware components when measuring a weight of the patient 85. The data analysis logic may also be configured to measure or determine the speed at which the actuator 450 is operating (i.e. taking in or paying out the lift strap 60) and/or the speed at which transfer motor 290 is operating (i.e. driving the carriage 20 along the rail 10 (depicted in FIG. 1A)). The data analysis logic may further be configured to measure the current supplied from the battery 456 or other power source to the actuator 450 and transfer motor 290.

The speed determination logic includes one or more programming instructions for determining a desired speed of operation of the overhead lift unit 100 (depicted in FIG. 1A). For instance, based on the data received by the data receiving logic (i.e. the weight of the patient 85 depicted in FIG. 1B), the speed determination logic may determine a speed for the actuator 450 to take-in or pay-out the lift strap 60 and/or a speed for the transfer motor 290 to drive the overhead lift unit 100 along the rail 10 (depicted in FIG. 1A). The actuator 450 and transfer motor 290 may operate at a maximum speed when no weight is detected on the lift strap 60. As increasing weight is detected on the lift strap 60, the speed determination logic may reduce the operating speeds of the actuator 450 and transfer motor 290. Reducing the operating speeds of the actuator 450 and transfer motor 290 may likewise reduce the likelihood of patients attached to the lift strap 60 undesirably swinging during operation of the overhead lift unit 100 (depicted in FIG. 1A). The determination of a desired hoisting (lifting or lowering patient 85 by taking in or paying out the lift strap 60) or driving speed (traversing the overhead lift unit 100 along the rail 10) may be made with reference to one or more algorithms concerning the determined patient weight. In other words, based on the detected weight of the patient 85, the electronic control unit 454 may modulate the actuator 450 and the transfer motor 290, and specifically regulate their speed of operation. The determination of desired operating speeds may also be determined from a look-up table (LUT) stored in the memory of the control unit and indexed according to, for example, weight attached to the lift strap. The determination of desired operating speeds may also be determined by a detected current in the actuator 450 and/or transfer motor 290. The determination of desired operating speeds may also be influenced or dictated by caregiver input through the hand controller 90 or other device. For example, the hand controller 90 may display the weight detected on the lift strap 60, and based on the reported weight, the caregiver may select a speed the caregiver is comfortable operating the overhead lift 100 unit at. The determination of desired operating speeds may also be influenced by historic use data. For instance, through the hand controller 90 or other device, following an operation of the overhead lift unit 100, a caregiver may label a previous operation as acceptable (i.e. no-to-minimal patient swinging) or unacceptable (i.e. patient swinging). The speed determination logic may then retrieve the highest operation speed associated with a current patient weight supported on the lift strap 60 that was previously labeled as safe by a caregiver and operate the overhead lift unit 100 at the retrieved speed. The weight of the patient 85 may also be displayed on a monitor or other device in view of the caregiver instead of, or in conjunction with, the hand controller 90. The hand controller 90 may also display the weight of the patient 85 supported on the lift strap 60 during operation of the overhead lift unit 100 without caregiver input. For example, in embodiments where the speed determination logic automatically modulates the actuator 450 (i.e. by regulating the speed of take-up or pay-out the lift strap 60) and/or the transfer motor 290 (i.e. by regulating the speed that the carriage 20 is driven along the rail 10 (depicted in FIG. 1A)) based on the weight of the patient 85, the hand controller 90 may still display the weight of the patient 85 for the caregiver's reference.

The pulse width modulation logic includes one or more programming instructions for determining a desired pulse width modulation of the actuator 450 and/or transfer motor 290. During acceleration and deceleration of the actuator and/or transfer motor, the pulse width modulation logic may instruct the power source, such as the battery 456, to pulse power to the actuator 450 and/or transfer motor 290. The pulse width modulation logic may determine a specific pulse width modulation for a hoisting or driving operation based on the detected weight of the patient 85 supported on the lift strap 60. In other words, based on the weight of the patient 85 and a maximum speed of operation determined by the speed determination logic, the pulse width modulation logic determines a desired pulse width modulated control signal to smoothly accelerate the actuator 450 and/or transfer motor 290 to the maximum speed and decelerate the actuator 450 and/or transfer motor 290 from the maximum speed. In embodiments, the pulse width modulation applied to the actuator 450 and/or the transfer motor 290 may be determined for example, using a look-up table (LUT) stored in the memory of the control unit and indexed according to, for example, weight supported on the lift strap and the speed of operation of the lift unit. Accordingly, the actuator 450 and transfer motor 290 may smoothly accelerate and decelerate, minimizing the likelihood of a patient attached to the lift strap 60 swinging or swaying during hoisting and/or driving operation.

The device interface logic includes one or more programming instructions for establishing communicative connections with the various devices or components of the overhead lift unit 100 (depicted in FIG. 1A). For example, the device interface logic may include programming instructions usable to establish connections with the strain gauge 330, transfer motor 290, actuator 450, and battery 456 in various embodiments.

Still referring to FIG. 6, the network interface hardware 608 may include any wired or wireless networking hardware, such as a modem, LAN port, wireless fidelity (Wi-Fi) card, WiMax card, mobile communications hardware, and/or other hardware for communicating with other networks and/or devices. For example, the network interface hardware 608 may be used to facilitate communication between external storage devices, user computing devices, server computing devices, external control devices, and/or the like via a network, such as, for example, a local network, the Internet, and/or the like.

The device interface hardware 610 may communicate information between the local interface 600 and one or more components of the overhead lift unit 100 (depicted in FIG. 1A). For example, the device interface hardware 610 may act as an interface between the local interface 600 and the battery 456, the actuator 450, the transfer motor 290, and the strain gauge 330. The device interface hardware 610 may transmit or receive signals and/or data to/from the strain gauge 330, the transfer motor 290, the actuator 450, and/or the battery 456.

Still referring to FIG. 6, the data storage component 606, which may generally be a storage medium, may contain one or more data repositories for storing data that is received and/or generated. The data storage component 606 may be any physical storage medium, including, but not limited to, a hard disk drive (HDD), memory, removable storage, and/or the like. While the data storage component 606 is depicted as a local device, it should be understood that the data storage component 606 may be a remote storage device, such as, for example, a server computing device, cloud based storage device, or the like. Illustrative data that may be contained within the data storage component 606 includes, but is not limited to, strain gauge data 620, patient data 622 (including but not limited to an identification of the patient 85 (depicted in FIG. 1B), a weight of the patient 85, and the like), operation data 624, machine learning data 626, and other data 628. The strain gauge data 620 may generally be data that is used by the electronic control unit 454 to determine weights of patients 85 currently attached to the lift strap 60, analyze weights of previous patients 85 attached to the lift strap 60, and/or the like. The patient data 622 may generally be data that is used by the electronic control unit 454 to identify a patient 85 attached to the lift strap 60, identify particular health information of interest associated with a patient 85, associate a patient weight with a particular patient 85, identify past hoisting and driving operations completed with a particular patient 85 on the lift strap, and/or the like. The operation data 624 may generally be data that is used by the electronic control unit 454 to identify a preferred speed of a hoisting or driving operation, identify a preferred pulse width modulation to accelerate to or decelerate from a preferred speed of operation, identify past operations parameters associated with a particular patient 85, identify past operational parameters for a given weight on the lift strap 60, and/or the like. The machine learning data 626 may generally be data that is generated as a result of one or more machine learning processes used to improve the determination of a preferred or optimal operational speed of the overhead lift unit 100 (depicted in FIG. 1A) based on a detected patient weight, for instance. The other data 628 may generally be any other data that is usable for the purposes of detecting a patient weight on a lift strap 60, developing a preferred operation speed of the overhead lift unit 100 based on the patient weight, identifying a preferred pulse width modulation based on the patient weight and preferred operational speed, and/or the like, as described herein.

It should be understood that the components illustrated in FIG. 6 are merely illustrative and are not intended to limit the scope of this disclosure. More specifically, while the components in FIG. 6 are illustrated as residing within the electronic control unit 454, this is a non-limiting example. In some embodiments, one or more of the components may reside external to the electronic control unit 454.

Figure 7:
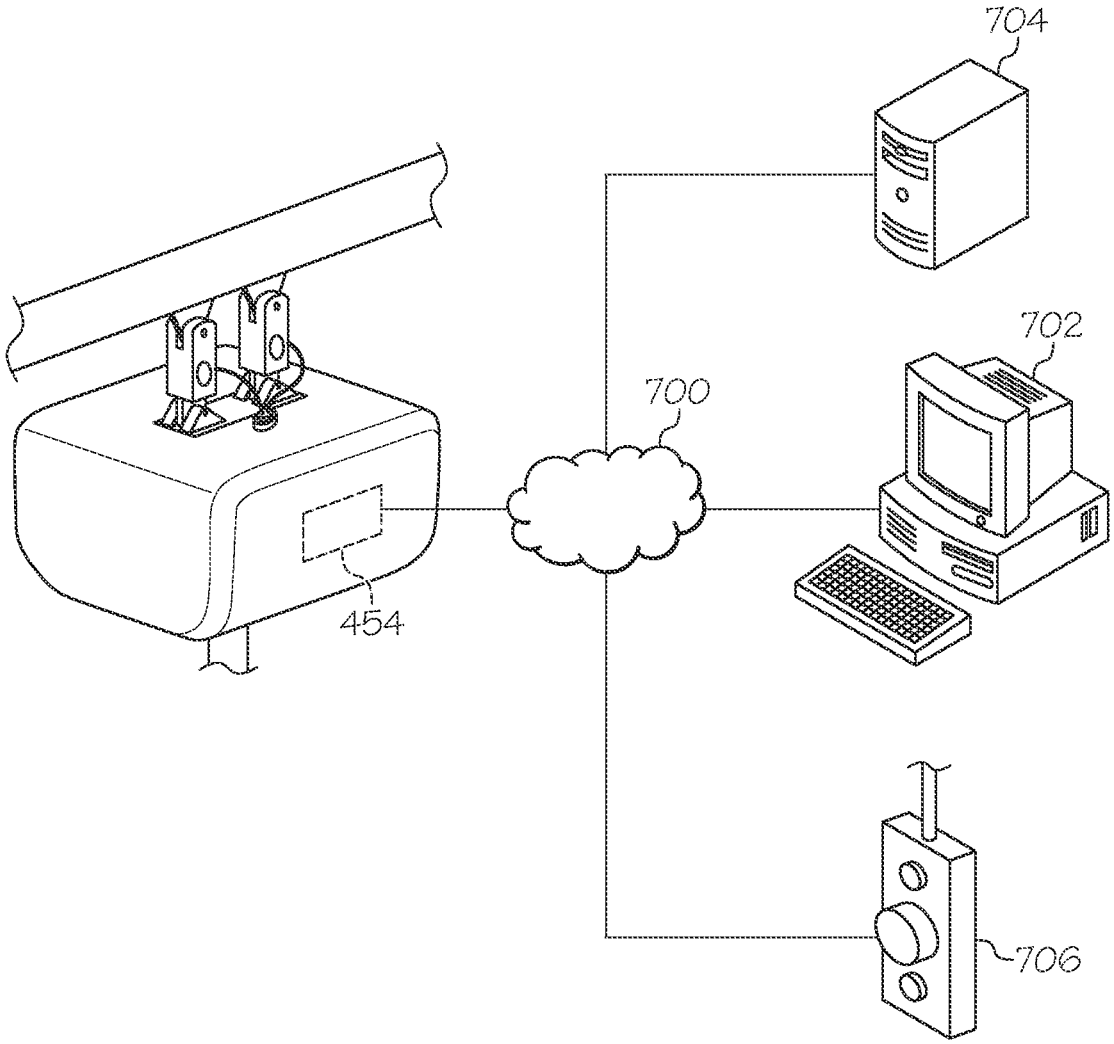
FIG. 7 depicts an illustrative control network, according to one or more embodiments shown and described herein.

Referring now to FIG. 7, an illustrative control network 700 is depicted. As illustrated in FIG. 7, the control network 700 may include a wide area network (WAN), such as the Internet, a local area network (LAN), a mobile communications network, a public service telephone network (PSTN), a personal area network (PAN), a metropolitan area network (MAN), a virtual private network (VPN), and/or another network. The control network 700 may generally be configured to electronically connect one or more systems and/or devices, such as, for example, computing devices, servers, electronic devices, overhead lift units, and/or components of any of the foregoing. Illustrative systems and/or devices may include, but are not limited to, a user computing device 702, a database server 704, an electronic device 706, and/or the electronic control component 454 of the an overhead lift unit.

Still referring to FIG. 7, the user computing device 702 may generally be used as an interface between a user and the other components connected to the control network 700. Thus, the user computing device 702 may be used to perform one or more user-facing functions, such as receiving one or more inputs from a user or providing information to the user. Accordingly, the user computing device 702 may include at least a display and/or input hardware. In the event that any of the other devices connected to the control network 700 (e.g., the database server 704, the electronic device 706, and/or the electronic control unit 454), requires oversight, updating, and/or correction, the user computing device 702 may be configured to provide the desired oversight, updating, and/or correction. The user computing device 702 may also be used to input data that is usable to determine a lift operation to complete, a patient 85 to lift with the overhead lift unit 100 (depicted in FIGS. 1A and 1B), a speed to operate the overhead lift unit 100, a rate of acceleration or deceleration of the operation of the overhead lift 100, and/or the like. That is, a user may input information via the user computing device 702 to control various parameters of the overhead lift unit 100.

The database server 704 may generally be a repository of data that is used for the purposes of determining an operational speed or pulse width modulation of the overhead lift unit 100 (depicted in FIG. 1A) as described herein. That is, the database server 704 may contain one or more storage devices for storing data pertaining to information received from the strain gauge 330 (depicted in FIG. 3), any generated calculations, and/or the like. In some embodiments, the database server 704 may contain information therein that mirrors the information stored in the data storage component 606 (FIG. 6) or may be used as an alternative to the data storage component 606, such as an offsite data repository. The database server 704 may be accessible by one or more other devices and/or systems coupled to the control network 700 and may provide the data as needed. Accordingly, the database server 704 may share data between multiple overhead lift units 100 throughout a hospital or other facility. In other words, an operational speed of a first overhead lift unit 100 when operating with a known weight and labeled by a first caregiver as a safe speed of operation may be shared with a second overhead lift unit 100 and second caregiver operating the same known weight.

The electronic device 706 may generally be any device that contains hardware that is operable to be used as an interface between a user and the other components of the control network 700. Thus, the electronic device 706 may be used to perform one or more user-facing functions, such as, for example, receiving data from one or more external components, displaying information to a user, receiving one or more user inputs, transmitting signals corresponding to the one or more user inputs, and/or the like. The electronic device 706 may be the hand controller 90 (depicted FIG. 1A). The electronic device 706 may be any mobile phone, a tablet computing device, a personal computing device (e.g., a personal computer), and/or the like.

It should be understood that while the user computing device 702 is depicted as a personal computer, the database server 704 is depicted as a server, and the electronic device 706 is depicted as a subject lift controller, these are non-limiting examples. In some embodiments, any type of computing device (e.g., mobile computing device, personal computer, server, cloud-based network of devices, etc.) or specialized electronic device may be used for any of these components. Additionally, while each of these computing devices is illustrated in FIG. 7 as a single piece of hardware, this is also merely an example. Each of the user computing device 702, the database server 704, and the electronic device 706 may represent a plurality of computers, servers, databases, components, and/or the like.

While FIG. 7 depicts the various systems and/or components communicatively coupled to one another via the control network 700, this is merely illustrative. In some embodiments, various components may be communicatively coupled to one another via a direct connection. In some embodiments, various components may be integrated into a single device.

Referring now to FIGS. 1A-6, a method of calibrating the overhead lift unit 100 will now be discussed with reference to the figures. Prior to operation of the overhead lift 100 with the patient 85 attached to the overhead lift unit 100, the overhead lift unit 100 may be calibrated. Calibration of the overhead lift unit 100 may ensure the accuracy of the overhead lift unit 100 in determining a weight of the patient 85 attached to the lift strap 60 within a specified degree of accuracy. For instance, the overhead lift unit 100 may be calibrated to satisfy standard specifications and requirements set by the International Organization of Legal Metrology.

At an initial step, a user may attach a first known weight to the lift strap 60 of the overhead lift unit 100. In embodiments, the first known weight may be attached to the lift strap 60 through one or more attachments, such as the sling 86 and/or sling bar 80. In such embodiments, the user may zero the system with the hand controller 90 or other interface with the attachment, such as the sling 86 and/or sling bar 80, attached to the lift strap 60 and prior to coupling the first known weight to the attachment. The weight or load from the first known weight may then be transferred through the lift strap 60 and the lift frame 400 to the load beams 30 and 40. A first tension readout may be registered in the load beam 30 with the first known weight attached to the lift strap 60, and a first tension readout may be registered in the load beam 40 with the first known weight attached to the lift strap 60.

More particularly, the first tension readout in the load beam 30 may be registered by the strain gauge 330 in the first load beam 30, and the first tension readout in the load beam 40 may be registered by the strain gauge 330 in the load beam 40. The first tension readout in the load beam 30 and the first tension readout in the load beam 40 may be displayed on the hand controller 90, for instance, and/or stored in the data storage component 606. Following the determination of the first tension readouts in the load beams 30 and 40, the first known weight may be removed from the lift strap 60, and a second known weight may be attached to the lift strap 60 of the overhead unit 100. In embodiments, the second known weight may have a different weight than the first known weight. In embodiments, the second known weight may be attached to the lift strap 60 through one or more attachments, such as the sling 86 and/or sling bar 80. In such embodiments, the user may zero the system with the hand controller 90 or other interface with the attachment, such as the sling 86 and/or sling bar 80, attached to the lift strap 60 and prior to coupling the second known weight to the attachment. The weight or load from the second known weight may then be transferred through the lift strap 60 and the lift frame 400 to the load beams 30 and 40. A second tension readout may be registered in the load beam 30 with the second known weight attached to the lift strap 60, and a second tension readout may be registered in the load beam 40 with the second known weight attached to the lift strap 60. More particularly, the second tension readout in the load beam 30 may be registered by the strain gauge 330 in the first load beam 30, and the second tension readout in the load beam 40 may be registered by the strain gauge 330 in the load beam 40. The second tension readout in the load beam 30 and the second tension readout in the load beam 40 may be displayed on the hand controller 90, for instance, and/or stored in the data storage component 606.

As discussed above, in embodiments, the lift strap 60 may extend from the center of mass 430 of the lift frame 400, and the load beams 30, 40, when attached to the connection points 110 and 112, may be positioned on the longitudinal centerline 460 passing through the center of mass 430 and equidistantly and symmetrical spaced from the lateral centerline 440 passing through the center of mass 430. Accordingly, in such embodiments, the overhead lift unit 100 is fundamentally balanced such that a weight L attached to the lift strap 60 is transferred to the load beams 30 and 40 as reaction forces R1 and R2, respectively. In other words, the sum of R1 and R2, in all cases, equals the weight L. Ideally, the sum of the first tension readout in the load beam 30 and the first tension readout in the load beam 40 should equal the first known weight, for instance. However, due to inherent error in the electronics of the strain gauges 330 of the load beams 30 and 40, for example, the strain gauges 330 may not operate ideally. In other words, the sum of the first tension readout in the load beam 30 and the first tension readout in the load beam 40 may not equal the first known weight. Therefore, in order to correct or accommodate for the non-ideal operation of the strain gauges 330, a first load beam constant may be calculated for the load beam 30 and a second load beam constant may be calculated for the load beam 40. Particularly, due to the principle that the sum of R1 and R2 equals the weight L, load beam constants for the load beams 30 and 40 may be determined from the known values of the first known weight and the second known weight, and the determined values of the first tension readout in the load beam 30, the first tension readout in the load beam 40, the second tension readout in the load beam 30, and the second tension readout in the load beam 40.

More specifically, load beam constants for the load beams 30 and 40 may be solved for using a calibration algorithm comprising the matrix equation:

$$\underline{T}\underline{k}=\underline{W}. \tag{1}$$

$\underline{T}$ is a 2×2 matrix in the form:

$$\underline{T}=\begin{bmatrix} T11 & T21 \\ T12 & T22 \end{bmatrix} \tag{2}$$

where T11 is the first tension readout in the load beam 30, T21 is the first tension readout in the load beam 40, T12 is the second tension readout in the load beam 30, and T22 is the second tension readout in the load beam 40. $\underline{W}$ is a column vector, or a 2×1 matrix in the form:

$$\underline{W}=\begin{bmatrix} w1 \\ w2 \end{bmatrix}, \tag{3}$$

where w1 is the weight of the first known weight, and w2 is the weight of the second known weight. $\underline{k}$ is a column vector, or a 2×1 matrix in the form:

$$\underline{k}=\begin{bmatrix} k1 \\ k2 \end{bmatrix}, \tag{4}$$

where k1 is the load beam constant for the load beam 30 and k2 is the load beam constant for the load beam 40. As the values for $\underline{T}$ and $\underline{W}$ are known, $\underline{k}$ may be solved for using the equation:

$$\underline{T}^{-1}\underline{W}=\underline{k}. \tag{5}$$

Accordingly, k1, the load beam constant for the load beam 30, and k2, the load beam constant for the load beam 40, may be determined. Once the load beam constants k1 and k2 are determined, the overhead lift unit 100 may be said to be calibrated such that ensuing weights, such as the patient 85, attached to the lift strap 60 may be determined within a desired degree of accuracy, as required by the International Organization of Legal Metrology, for instance. For instance, following the calibration of the overhead lift unit 100, the weight of the patient 85 may be determined using the equation:

$$\underline{T}_m\underline{k}=W_s. \tag{6}$$

$\underline{T}_m$ is a row vector or 1×2 matrix in the form:

$$\underline{T}_m=[T_1T_2], \tag{7}$$

where $T_1$ is a tension readout in the load beam 30, and $T_2$ is a tension readout in the load beam 40. Multiplying the row vector $\underline{T}_m$ with the column vector $\underline{k}$ results in a scalar value, $W_s$, which is the weight suspended from the lift strap 60 (i.e., the weight of patient 85).

It should be appreciated that while the solution for the load beam constant for the load beam 30 and the load beam constant for the load beam 40 were solved for above using matrix equations, that this is a non-limiting example of calibrating the overhead lift unit 100. In other words, the basic mathematical principles behind the calibration algorithm described above may be readily implemented in various different equations and processes. Merely, as an example, the calibration algorithm may utilize a system of equations, such as:

$$k1(T11)+k2(T21)=w1$$

$$k1(T12)+k2(T22)=w2. \tag{8}$$

Following the suspension of the first known weight and the second known weight from the lift strap 60 and recordation of the tension readouts in the load beams 30 and 40 from the suspension of the first and second known weights, k1, the load beam constant for the load beam 30, and k2, the load beam constant for the load beam 40, remain the only unknown values in the above system of equations. Accordingly, the above system of equations may be solved for the load beam constants of the load beams 30 and 40. Similarly, it should be appreciated that alternative matrix equations to those discussed with equations (1)-(5) may be used in the calibration algorithm to determine the load beam constants for the load beams 30 and 40. For instance, the load beam constants for the load beams 30 and 40 may be solved for using the matrix equation:

$$\underline{kT}=\underline{W}. \tag{9}$$

$\underline{T}$ is a 2×2 matrix in the form:

$$\underline{T}=\begin{bmatrix} T11 & T12 \\ T21 & T22 \end{bmatrix} \tag{10}$$

where T11 is the first tension readout in the load beam 30, T21 is the first tension readout in the load beam 40, T12 is the second tension readout in the load beam 30, and T22 is the second tension readout in the load beam 40. $\underline{W}$ is a row vector, or a 1×2 matrix in the form:

$$\underline{W}=[w1w2], \tag{11}$$

where w1 is the weight of the first known weight, and w2 is the weight of the second known weight. $\underline{k}$ is a row vector, or a 1×2 matrix in the form:

$$\underline{k}=[k1k2], \tag{12}$$

where k1 is the load beam constant for the load beam 30 and k2 is the load beam constant for the load beam 40. As the values for $\underline{T}$ and $\underline{W}$ are known, $\underline{k}$ may be solved for using the equation:

$$\underline{WT}^{-1}=\underline{k}. \tag{13}$$

In embodiments, the control unit 454 may be configured to carry out the calibration method and calibration algorithm described above. For instance, the processing device 602 may be configured to receive and execute calibration instructions from a calibration logic module of the memory component 604. In embodiments, a user may initiate a calibration process through the hand controller 90, user computing device 702, and/or the electronic device 706. Before or after initiating the calibration process, the user may attach the first known weight to the lift strap 60 and input the weight of the first known weight into the memory component 604. The data receiving logic of the memory component 604 may then receive data from the one or more strain gauges 330 in the load beams 30 and 40, and more particularly, may receive data indicative of the first tension readout in the load beam 30 and the first tension readout in the load beam 40. The user may then remove the first known weight from the lift strap 60, attach the second known weight to the lift strap 60, and indicate on the hand controller 90, user computing device 702, and/or electronic device 706 that the second leg or segment of the of the calibration method has commenced. The user may further input the weight of the second known weight through the hand controller 90, user computing device 702, and/or electronic device 706. The data receiving logic of the memory component 604 may then receive data from the one or more strain gauges 330 in the load beams 30 and 40, and more particularly, may receive data indicative of the second tension readout in the load beam 30 and the second tension readout in the load beam 40. The data analysis logic of the memory component 604 may then complete the computation indicated in equations (1)-(5) of the calibration algorithm, for instance, to determine the load beam constant for the load beam 30 and the load beam constant for the load beam 40. The determined load beam constant for the load beam 30 and the load beam constant for the load beam 40 may be stored in the data storage component 606, and particularly, for instance, in the strain gauge data 620. The strain gauge data 620 may then use the load beam constants to complete the computation indicated in equations (6)-(7), for instance, to determine a weight of the patient 85 on the lift strap 60 during future operation of the overhead lift unit 100.

Because, in embodiments, the overhead lift unit 100 is fundamentally balanced (i.e. the load beams 30, 40 are positioned on the longitudinal centerline 460 passing through the center of mass 430 of the lift frame 400 and are equidistantly and symmetrical spaced from the lateral centerline 440 passing through the center of mass 430 of the lift frame 400), as discussed above, it is possible to calibrate the overhead lift unit 100 using a first known weight and second known weight at a low end of a weight spectrum. In other words, the overhead lift unit 100 may be calibrated using known weights that are lighter than weights used in traditional calibration processes. Specifically, in some embodiments, the first known weight and the second known weight may each weigh less than forty pounds. In embodiments, the first known weight and the second known weight may each weigh less than thirty pounds. In embodiments, the first known weight and the second known weight may each weigh less than twenty pounds. In embodiments, the first known weight and the second known weight may each weigh less than ten pounds. In embodiments, the first known weight and the second known weight may each weigh less than five pounds.

In contrast, during traditional calibration methods of overhead lift units, heavier known weights that are closer in weight to expected patient weights are required to calibrate the overhead lift units. The overhead lift unit 100, however, may be calibrated with the first known weight and the second known weight that are light enough to easily be carried by a user or technician, who may travel between various sites with the first and second known weights to calibrate various overhead lift units 100.

Moreover, it has been shown that use of the first and second known weights within the ranges discussed above does not compromise the accuracy of the calibration process. In other words, the maximum error of the overhead lift unit 100 in determining the weight of the patient 85 attached to the lift strap 60 following the calibration process above is no greater than the maximum error of an overhead lift unit calibrated with traditional weights closer to expected weights of patients. The position of the maximum error within the scale range of the overhead lift unit 100 may be affected, however. For instance, when calibrating the overhead lift unit 100 with the first and second known weights within the ranges discussed above, the overhead lift unit 100 may experience a maximum error toward the upper end of the scale range (i.e. the maximum weights the overhead lift unit 100 is configured to measure). In contrast, if the overhead lift unit 100 were calibrated using known weights toward the upper end of the scale range, the overhead lift unit 100 may experience a maximum error toward the lower end of the scale range (i.e. the minimum weights the overhead lift unit 100 is configured to measure).

Referring now to FIGS. 1A-6, a method of operation of the overhead lift unit 100 will now be discussed with specific reference to the figures. In embodiments, the method of operation discussed herein may be completed following the method of calibration discussed above. At an initial step, a caregiver may attach a patient 85 to the overhead lift unit 100 through one or more attachments, such as the sling 86 and/or sling bar 80. As such, the patient 85 may be attached to the lift strap 60, and the weight or load of the patient 85 may be transferred through the lift strap 60 and lift frame 400 to the load beams 30 and 40. It should be noted that prior to attaching the patient 85 to the lift strap 60, the caregiver may optionally zero the system with a control on the hand controller 90 or other interface. After the load of the patient 85 is transferred to the load beams 30, 40, the electronic control unit 454 coupled load beams 30, 40 may determine the weight of the patient 85 supported on the lift strap 60. The determined weight of the patient 85 may be optionally displayed on the hand controller 90 or other interface for the caregiver to view.

In some embodiments, based on the detected weight of the patient 85, the electronic control unit 454 may automatically modulate the operation of the overhead lift unit 100. More specifically, the electronic control unit 454 may modulate the actuator 450 that pays-out and takes-in the lift strap 60 from the lift frame 400. That is, the electronic control unit 454 determines maximum operating speed of the actuator 450 based on the detected weight of the patient 85 and any other relevant data, such as patient-identifying data, historic operation data, and the like. Based on the detected weight of the patient 85 and the determined operating speed of the actuator 450, the electronic control unit may also determine a pulse width modulation of the actuator 450 to smooth the acceleration and deceleration of the lift strap 60 and the load attached thereto. The modulation of the actuator 450 (i.e. the determination of a speed of operation, acceleration, and a pulse width modulation of the actuator 450) may be determined by the electronic control unit 454 to prevent the patient 85 from swaying or swinging on the lift strap 60 as the patient is lifted or lowered.

The electronic control unit 454 may also modulate the transfer motor 290 that drives the carriage 20 along the rail 10. The electronic control unit 454 may regulate the speed that the transfer motor 290 drives the carriage 20 along the rail 10. Put another way, the electronic control unit 454 determines a maximum operating speed of the transfer motor 290 based on the detected weight of the patient 85 and any other relevant data, such as patient-identifying data, historic operation data, and the like. Based on the detected weight of the patient 85 and the determined operating speed of the transfer motor 290, the electronic control unit may also determine a pulse width modulation of the transfer motor 290 to smooth the acceleration and deceleration that the transfer motor 290 drives the carriage 20 along the rail. The modulation of the transfer motor 290 (i.e. the determination of a speed of operation, an acceleration, and a pulse width modulation of the transfer motor 290) may be determined by the electronic control unit 454 to prevent the patient 85 from swaying or swinging on the lift strap 60 as the overhead lift unit 100 traverses the rail 10.

In other embodiments, the electronic control unit 454 may not automatically modulate the actuator 450 and the transfer motor 290. In such embodiments, the caregiver, based on the display of the weight of the patient 85 on the hand controller 90 or other display, may provide instructions for the operation of the overhead lift unit 100. The caregiver may provide the instructions through hand controller 90. The caregiver may select a desired maximum speed of operation of the actuator 450 and transfer motor 290. The caregiver may also select a desired pulse width modulation, or acceleration to and deceleration from the desired maximum speeds of the actuator 450 and transfer motor 290.

Based on the foregoing, it should now be understood that the embodiments shown and described herein relate to an overhead lift unit for lifting and transporting patients. The overhead lift unit includes a pair of load beams pivotably and detachably connected to corresponding connection points of a lift frame. The pair of load beams are further pivotably and detachably connected to corresponding connection points of a carriage, where the carriage comprises a first unit and a second that are hingedly attached. The pair of load beams include strain gauges coupled to an electronic control unit of the overhead lift unit and operable to detect a weight attached to a lift strap of the overhead lift unit. The electronic control unit, based on the detected weight attached to the lift strap, may determine a speed to lift or lower the lift strap or drive the overhead lift unit along an overhead rail. The electronic control unit may further determine an acceleration and deceleration to and from the determined speed based on the detected weight on the lift strap.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the specific value or end-point referred to is included. Whether or not a numerical value or end-point of a range in the specification recites "about," two embodiments are described: one modified by "about," and one not modified by "about." It will be further understood that the endpoints of each of the ranges are significant both in relation to the other endpoint, and independently of the other endpoint.

Directional terms as used herein—for example up, down, right, left, front, back, top, bottom—are made only with reference to the figures as drawn and are not intended to imply absolute orientation.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

As used herein, the singular forms "a," "an" and "the" include plural referents unless the context clearly dictates otherwise. Thus, for example, reference to "a" component includes aspects having two or more such components, unless the context clearly indicates otherwise.

For the purposes of describing and defining the present invention, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is noted that recitations herein of a component of the present disclosure being "configured" or "programmed" in a particular way, to embody a particular property, or function in a particular manner, are structural recitations, as opposed to recitations of intended use. More specifically, the references herein to the manner in which a component is "programmed" or "configured" denotes an existing physical condition of the component and, as such, is to be taken as a definite recitation of the structural characteristics of the component.

It is noted that terms like "preferable," "typical," and "suitable" when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. An overhead lift unit comprising:

a carriage, the carriage comprising wheels engageable with a rail;

a lift frame coupled to the carriage such that the lift frame is suspended from the carriage, the lift frame comprising:

a lift strap extending from the lift frame;

an actuator coupled to the lift strap, the actuator selectively paying-out and taking up the lift strap; and a pair of connection points extending from the lift frame;

a pair of load beams, wherein:

each load beam of the pair of load beams is attached to one connection point of the pair of connection points of the lift frame at an inferior end of the load beam;

each load beam of the pair of load beams is attached to the carriage at a superior end of the load beam; and each load beam of the pair of load beams comprises a strain gauge operable to register a weight supported on the lift strap; and an electronic control unit communicatively coupled to each load beam and the actuator, the electronic control unit comprising a processor communicatively coupled to a non-transitory memory storing computer readable and executable instructions that, when executed by the processor cause the processor to receive signals from each load beam indicative of a weight supported on the lift strap and modulate the pay-out or take-up of the lift strap based on the weight supported on the lift strap.

2. The overhead lift unit of claim 1, wherein the computer readable and executable instructions further cause the processor to display the weight supported on the lift strap on a hand controller of the overhead lift unit.

3. The overhead lift unit of claim 1, further comprising a transfer motor coupled to the wheels of the carriage and configured to drive the overhead lift unit along the rail when the wheels are engaged with the rail, wherein:

the electronic control unit is communicatively coupled to the transfer motor; and the computer readable and executable instructions, when executed by the processor, further cause the processor to modulate a traverse rate of the transfer motor based on the weight supported on the lift strap.

4. The overhead lift unit of claim 1, wherein the computer readable and executable instructions, when executed by the processor, further cause the processor to transmit the weight supported on the lift strap and one or more operating parameters of the overhead lift unit to a wireless control network.

5. The overhead lift unit of claim 1, further comprising a housing, wherein:

the housing at least partially encloses the lift frame; and each connection point of the pair of connection points extends from a superior surface of the housing.

6. The overhead lift unit of claim 5 further comprising a boot, wherein:

the boot couples to the superior surface of the housing at a bezel; and the boot laterally surrounds the pair of load beams.

7. The overhead lift unit of claim 1, wherein each load beam comprises a strain relief connector, wherein an electrical interconnect of the strain gauge of each load beam extends from each load beam through the strain relief connector.

8. The overhead lift unit of claim 1, wherein:

the lift strap extends from a center of mass of the lift frame;

the pair of load beams are positioned on a longitudinal centerline of the lift frame passing through the center of mass of the lift frame; and the pair of load beams are equidistantly and symmetrically spaced from a lateral centerline of the lift frame passing through the center of mass of the lift frame.

9. The overhead lift unit of claim 1, wherein:

the carriage comprises a first carriage unit and a second carriage unit, wherein each of the first carriage unit and the second carriage unit comprise:

a truck; and wheels extending from the truck, wherein the truck of the first carriage unit and the truck of the second carriage unit are hingedly connected.

10. The overhead lift unit of claim 1, wherein each load beam of the pair of load beams comprises a tab at the inferior end, the tab having a tab width less than a body width of the load beam.

11. The overhead lift unit of claim 10, wherein:

each connection point of the pair of connection points of the lift frame comprises a clevis; and the tab of each load beam is pivotably connected to a corresponding clevis of the pair of connection points.

12. The overhead lift unit of claim 11, wherein each load beam of the pair of load beams comprises a clevis at the superior end of each load beam.

13. The overhead lift unit of claim 12, wherein each load beam is pivotably connected to the carriage at the clevis of each load beam.

14. A method of operating an overhead lift unit comprising:

determining, with an electronic control unit, a weight supported on a lift strap of the overhead lift, wherein a lift frame of the overhead lift is coupled to a rail with load beams communicatively coupled to the electronic control unit and the load beams are operable to detect the weight supported on the lift strap;

displaying the weight supported on the lift strap on a display device; and modulating an actuator of the overhead lift unit based on the determined weight supported on the lift strap, wherein the actuator selectively pays-out or takes-in the lift strap from the overhead lift unit, wherein the modulating comprises:

determining a speed for the lift strap to be paid-out or taken-in from the lift frame; and determining an acceleration or deceleration for the lift strap to be paid-out or taken-in from the lift frame, wherein the actuator is pulse-width modulated to achieve the acceleration or deceleration.

15. The method of claim 14 further comprising modulating a transfer motor of the overhead lift unit based on the weight supported on the lift strap, wherein the transfer motor traverses the overhead lift unit along the rail.

16. The method of claim 15, wherein modulating the transfer motor comprises:

determining a speed for the overhead lift unit to be traversed along the rail; and determining an acceleration or deceleration for the overhead lift unit to be traversed along the rail, wherein the transfer motor is pulse width modulated to achieve the acceleration or deceleration.

17. A method of calibrating an overhead lift unit, comprising:

suspending a first known weight from a lift strap of the overhead lift unit, wherein the lift strap extends from a lift frame of the overhead lift unit;

suspending a second known weight from the lift strap of the overhead lift unit, wherein the overhead lift unit further comprises:

a pair of load beams, wherein:

each load beam of the pair of load beams is attached to one connection point of a pair of connection points of the lift frame; and each load beam of the pair of load beams comprises a strain gauge operable to register a weight supported on the lift strap;

determining a first load beam constant for a first load beam of the pair of load beams; and determining a second load beam constant for a second load beam of the pair of load beams, wherein:

the first load beam constant and the second load beam constant are determined based on:

the first known weight;

the second known weight; and tension readouts in the first load beam and the second load beam in response to suspending the first known weight and the second known weight from the lift strap.

18. The method of claim 17, wherein:

the pair of load beams are positioned on a longitudinal centerline of the lift frame passing through a center of mass of the lift frame; and the pair of load beams are equidistantly and symmetrically spaced from a lateral centerline of the lift frame passing through the center of mass of the lift frame.

19. The method of claim 18, wherein the lift strap extends from the center of mass of the lift frame.

20. The method of claim 17, wherein:

the first known weight is less than or equal to forty pounds; and the second known weight is less than or equal to forty pounds.

21. The method of claim 17, wherein:

the first known weight is less than or equal to thirty pounds; and the second known weight is less than or equal to thirty pounds.

22. The method of claim 17, wherein:

the first known weight is less than or equal to twenty pounds; and the second known weight is less than or equal to twenty pounds.

23. The method of claim 17, further comprising:

determining a first tension readout in the first load beam in response to suspending the first known weight from the lift strap;

determining a first tension readout in the second load beam in response to suspending the first known weight from the lift strap;

determining a second tension readout in the first load beam in response to suspending the second known weight from the lift strap; and determining a second tension readout in the second load beam in response to suspending the second known weight from the lift strap.

24. The method of claim 23, wherein:

the first load beam constant and the second load beam constant are determined in response to determining the first tension readout in the first load beam, the first tension readout in the second load beam, the second tension readout in the first load beam, and the second tension readout in the second load beam.

25. The method of claim 17, wherein:

the first load beam constant and the second load beam constant are determined with an electronic control unit of the overhead lift unit; and the determination of the first load beam constant and the second load beam constant is based at least in part on a calibration algorithm, wherein the calibration algorithm comprises a formula to determine the first load beam constant and the second load beam constant, wherein the formula comprises:

$$\underline{Tk} = \underline{W}, \text{ wherein:} \quad \text{(i)}$$

$$\underline{T} = \begin{bmatrix} T11 & T21 \\ T12 & T22 \end{bmatrix}, \text{ wherein:} \quad \text{(ii)}$$

T11 is a first tension readout in the first load beam in response to suspending the first known weight from the lift strap, T21 is a first tension readout in the second load beam in response to suspending the first known weight from the lift strap, T12 is a second tension readout in the first load beam in response to suspending the second known weight from the lift strap, and T22 is a second tension readout in the second load beam in response to suspending the second known weight from the lift strap;

$$\underline{W} = \begin{bmatrix} w1 \\ w2 \end{bmatrix}, \text{ wherein:} \quad \text{(iii)}$$

w1 is a weight of the first known weight, and w2 is a weight of the second known weight; and $$\underline{k} = \begin{bmatrix} k1 \\ k2 \end{bmatrix}, \text{ wherein:} \quad \text{(iv)}$$

k1 is the load beam constant for the first load beam and k2 is the load beam constant for the second load beam.

26. The method of claim 17, wherein:

the first load beam constant and the second load beam constant are determined with an electronic control unit of the overhead lift unit; and the determination of the first load beam constant and the second load beam constant is based at least in part on a calibration algorithm, wherein the calibration algorithm comprises a formula to determine the first load beam constant and the second load beam constant, wherein the formula comprises a system of equations further comprising:

$$k1(T11)+k2(T21)=w1$$

$$k1(T12)+k2(T22)=w2, \text{ wherein:}$$

T11 is a first tension readout in the first load beam in response to suspending the first known weight from the lift strap, T21 is a first tension readout in the second load beam in response to suspending the first known weight from the lift strap, T12 is a second tension readout in the first beam in response to suspending the second known weight from the lift strap, and T22 is a second tension readout in the second load beam in response to suspending the second known weight from the lift strap;

w1 is a weight of the first known weight, and w2 is a weight of the second known weight; and k1 is the load beam constant for the first load beam and k2 is the load beam constant for the second load beam.

27. An overhead lift unit comprising:

a carriage, the carriage comprising wheels engageable with a rail;

a lift frame coupled to the carriage such that the lift frame is suspended from the carriage, the lift frame comprising:

a lift strap extending from the lift frame;

an actuator coupled to the lift strap, the actuator selectively paying-out and taking up the lift strap; and a pair of connection points extending from the lift frame; and a pair of load beams, wherein:

each load beam of the pair of load beams is attached to one connection point of the pair of connection points of the lift frame at an inferior end of the load beam;

each load beam of the pair of load beams is attached to the carriage at a superior end of the load beam; and each load beam of the pair of load beams comprises a strain gauge operable to register a weight supported on the lift strap;

a housing, wherein:

the housing at least partially encloses the lift frame; and each connection point of the pair of connection points extends from a superior surface of the housing; and a boot, wherein:

the boot couples to the superior surface of the housing at a bezel; and the boot laterally surrounds the pair of load beams.

* * * * *